United States Patent [19]

Goodman et al.

[11] Patent Number: 4,945,234

[45] Date of Patent: Jul. 31, 1990

[54] METHOD AND APPARATUS FOR PRODUCING AN ARBITRARY EXCITATION SPECTRUM FOR FOURIER TRANSFORM MASS SPECTROMETRY

[75] Inventors: Seth Goodman, Madison, Wis.; Alan Hanna, Boulder, Colo.

[73] Assignee: Extrel FTMS, Inc., Madison, Wis.

[21] Appl. No.: 354,462

[22] Filed: May 19, 1989

[51] Int. Cl.[5] ..... H01J 49/26

[52] U.S. Cl. ..... 250/291; 250/281; 250/282; 250/292; 250/293; 250/290; 436/173

[58] Field of Search ..... 250/291, 292, 281, 282; 436/123; 174/32; 331/11; 340/552; 364/602, 604; 381/15, 62

[56] References Cited

U.S. PATENT DOCUMENTS

| | | | |
|---|---|---|---|
| 2,939,952 | 6/1960 | Paul et al. | 250/291 |
| 3,461,381 | 8/1969 | Nelson et al. | 250/291 |
| 3,475,605 | 10/1969 | Lyewellyn | 250/291 |
| 3,511,986 | 5/1970 | Llewellyn | 250/291 |
| 3,527,939 | 9/1970 | Dawson et al. | 250/291 |
| 3,742,212 | 6/1973 | McIver, Jr. | 250/291 |
| 3,937,955 | 2/1976 | Comisarow et al. | 250/291 |
| 3,984,681 | 10/1976 | Fletcher et al. | 250/291 |
| 4,034,191 | 7/1977 | Tomlinson et al. | 235/151.3 |
| 4,464,570 | 8/1984 | Allemann et al. | 250/291 |
| 4,500,782 | 2/1985 | Allemann et al. | 250/291 |
| 4,535,235 | 8/1985 | McIver, Jr. | 250/291 |
| 4,540,884 | 9/1985 | Stafford et al. | 250/282 |
| 4,581,533 | 4/1986 | Littlejohn et al. | 250/291 |
| 4,588,888 | 5/1986 | Ghaderi et al. | 250/291 |
| 4,682,027 | 7/1987 | Wells | 250/291 |
| 4,686,365 | 8/1987 | Meek et al. | 250/290 |
| 4,686,367 | 8/1987 | Louris et al. | 250/290 |
| 4,739,165 | 4/1988 | Ghaderi et al. | 250/291 |
| 4,755,670 | 7/1988 | Tyker et al. | 250/291 |
| 4,761,545 | 8/1988 | Marshall et al. | 250/291 |
| 4,771,172 | 9/1988 | Weber-Grabau et al. | 250/290 |
| 4,801,552 | 1/1989 | Hoff | 436/173 |
| 4,818,864 | 4/1989 | Allemann | 250/282 |
| 4,818,869 | 4/1989 | Weber-Grabau | 250/291 |
| 4,855,593 | 8/1989 | Bodenhausen et al. | 250/291 |

FOREIGN PATENT DOCUMENTS

| | | |
|---|---|---|
| 8604261 | 7/1986 | PCT Int'l Appl. . |
| 2106311 | 4/1983 | United Kingdom . |

OTHER PUBLICATIONS

Barrett L. Tomlinson and H. D. W. Hill, "Fourier Syn- (List continued on next page.)

*Primary Examiner*—Janice A. Howell
*Assistant Examiner*—Kiet T. Nguyen
*Attorney, Agent, or Firm*—Lathrop & Clark

[57] ABSTRACT

A desired mass domain excitation profile is selected and converted to a frequency domain excitation spectrum in which the frequency of excitation is generally proportional to the inverse of the mass-to-charge ratio. In the direct method of the invention, the specified frequency domain spectrum is converted by inverse Fourier transformation to a time domain waveform and multiplied by an expanded window function. The time domain waveform is forward Fourier transformed to produce a second discrete frequency spectrum each frequency of which is assigned a phase scrambled such that maximum reduction of peak excitation voltage is achieved with no distortion of the excitation amplitude spectrum. The phase-scrambled frequency spectrum is inverse Fourier transformed to produce the final time domain waveform which is used to generate the electric field which excites the ions in an ion cyclotron resonance cell. In the iterative method of the invention, the desired frequency spectrum is phase scrambled such that all frequencies are not in phase in any point in time, an inverse Fourier transform is performed on the phase scrambled frequency spectrum, and the result multipled by a window function. The time domain waveform is forward Fourier transformed to produce an output spectrum which is compared to a reference spectrum to provide correction factors which are used to predistort the magnitude of the final frequency spectrum, and the steps are repeated until the output frequency spectrum is sufficiently close to the reference spectrum, whereafter the time domain waveform corresponding to that output frequency spectrum is applied as the excitation signal.

42 Claims, 16 Drawing Sheets

OTHER PUBLICATIONS thesized Excitation of Nuclear Magnetic Resonance with Application to Homonuclear Decoupling and Solvent Line Suppression," Journal of Chemical Physics, vol. 59, No. 4, Aug. 15, 1973.

Alan G. Marshall and D. Christopher Roe, "Theory of Fourier Transform Ion Cyclotron Resonance Mass Spectroscopy: Response to Frequency-Sweep Excitation," Journal of Chemical Physics, vol. 73, No. 4, Aug. 15, 1980, pp. 1581-1590.

Alan G. Marshall, Tao-Chin Lin Wang, and Tom Labatuan Ricca, "Ion Cyclotron Resonance Excitation/De-Excitation: A Basis for Stochastic Fourier Transform Ion Cyclotron Mass Spectrometry," Chemical Physics Letters, vol. 105, No. 2, Mar. 9, 1984, pp. 233-235.

Alan G. Marshall, Tao-Chin L. Wang and Tom L. Ricca, "Fourier Transform Ion Cyclotron Resonance Mass Spectrometry: New Theoretical and Instrumental Developments," ASMS Meeting, San Antonio, Tex., May 27-Jun. 1, 1984, pp. 600-601.

Paper published by Finnigan MAT, entitled "New Advances in the Operation of the Ion Trap Mass Spectrometer," presented at the 33rd Annual Conference on Mass Spectrometry and Allied Topics, San Diego, Calif., May 1985.

U.S. patent application Ser. No. 695,847 for "Mass Spectrometer Ion Excitation System", filed Jan. 28, 1985, Group Art Unit: 256, Examiner: B. Anderson.

SWITCH POSITIONS

| | S1 | S2 | S3 |
|---|---|---|---|
| | A | A | C |
| | A | A | B |
| | - | - | A |
| | B | - | D |
| | C | B | D |

MODE

SWIFT EXCITE (DIRECT)
SWIFT EXCITE (HETERODYNE)
BURST/SWEEP EXCITE
RECEIVE (DIRECT)
RECEIVE (HETERODYNE)

METHOD AND APPARATUS FOR PRODUCING AN ARBITRARY EXCITATION SPECTRUM FOR FOURIER TRANSFORM MASS SPECTROMETRY

FIELD OF THE INVENTION

This invention pertains generally to the field of ion mass spectrometry and particularly to ion resonance excitation therefor.

BACKGROUND ART

An ion cyclotron uses a fixed magnetic field to deflect an ion moving at some velocity through the field. For a spatially uniform magnetic field having a flux density B, a moving ion of mass m and charge q will be bent into a circular path in a plane perpendicular to the magnetic field at an angular frequency $\omega_o$ in accordance with: $\omega_o = qB/m$. Thus, if the magnetic field strength is known, by measuring the ion cyclotron frequency it is possible in principle to determine the ionic mass-to-charge ratio m/q. In effect, the static magnetic field converts ionic mass into a frequency analog. Because the cyclotron frequencies for singly charged ions ($12 \leqq m/q \leqq 5000$) in a magnetic field of about 3 Tesla span a radio frequency range (10 kHz$\leqq$f$\leqq$4 MHz) within which frequency can be measured with high precision, the ion cyclotron is potentially capable of offering extremely high mass resolution and accuracy.

In an ion cyclotron cell, the ions may be formed by irradiation of a neutral gas, solid, or liquid by various known techniques, including the application of electron, ion, or laser beams. The ions are trapped in the cell because the magnetic field constrains the ions to a circular orbit in a plane perpendicular to the field, and a small DC potential is applied to the trapping plates of the cell prevents the ions from escaping in a direction parallel to the magnetic field. However, even ions having the same mass-to-charge ratio and the same initial velocity are created at random points in time, and therefore with random phase, i.e., having random angular positions in their circular paths. These incoherently moving ions cannot produce a detectable signal in the cell. To detect the ions, it is necessary to apply an oscillating electric field in a direction normal to the magnetic field and at the ions natural cyclotron frequency to drive the ions to orbit coherently in a larger radius orbit.

Various techniques have been used to detect the resonant ion cyclotron motion. One technique, as used in the omegatron type ion cyclotron resonance mass spectrometer, measures the current produced as ions continuously spiral outward into a detector plate. Another technique measures the power absorbed by the resonant ions from the exciting electric field. Such techniques generally rely on excitation of the ions with an oscillating electric field at a single frequency to detect ions of a single mass at a time. To collect a spectrum over a range of masses, either the excitation frequency or the magnetic field must be slowly swept. Both of these detection techniques were found to be badly limited with respect to mass resolution, sensitivity, and the time required to gather a mass spectrum. Significant increases in resolution, sensitivity, and speed have been obtained using Fourier transform techniques wherein the whole spectrum is excited at once and the whole spectrum is thereafter detected at once. Such Fourier transform ion cyclotron resonance spectroscopy techniques are described further in U.S. Pat. No. 3,937,955 issued to Comisarow et al., the disclosure of which is incorporated herein by reference.

Since introduction of Fourier transform mass spectrometry (FTMS), significant progress has been made in improving the detection of the resonant ions—for example: by reducing the base pressure in the cells, use of superconducting solenoid magnets, extending the bandwidth of the detection electronics, shielding of the transmitter and detector leads and using a differentially pumped dual cell or external ion source. However, the extremely high resolution (selectivity) realized by FTMS for ion detection cannot be achieved for ion excitation with current art techniques. This has proved a severe restriction for several experiments such as collisionally activated dissociation (CAD), for which FTMS is otherwise ideally suited, and which is of great importance to mass spectroscopists. What is required of an ion excitation technique for FTMS is the ability to selectively excite ions of arbitrary mass-to-charge ratio (hereafter denoted m/z) to arbitrary radii while not exciting other ions present. If the ion excitation is for the purpose of subsequent ion detection, it is necessary to know the ion orbital radius in order to quantify the number of ions from the magnitude of the detected signal. If the ion excitation is for the purpose of subsequent collision with target molecules or ions, it is necessary to achieve a desired ion orbital radius to achieve a desired ion kinetic energy.

Various ion excitation methods are in use today or have been proposed for use in FTMS. The simplest is burst excite, which is a fixed frequency, fixed amplitude sinusoidal signal applied to the cell excite plate for a fixed time. This excitation signal has the familiar (sin x)/x shape in its frequency domain magnitude spectrum. It is possible, using burst excite, to excite ions of one m/z to a desired orbital radius while not exciting at all ions of a second m/z. However, the only adjustable parameters are the sinusoidal frequency, amplitude, and duration, so the excite amplitude spectrum can only have a (sin x)/x shape, which is not suitable when ions of many different m/z are present.

An extension of the burst excite technique is to gradually sweep the frequency of the sinusoid from one frequency to another to excite all ions whose cyclotron frequencies are in that range. This is called sweep (also chirp) excite and is described in the previously mentioned Comisarow, et al. patent. Most commercially available FTMS instruments today use this method. Because this is a frequency modulated signal, the shape of its amplitude spectrum is not available as a convenient closed form equation. The spectral shape is generally a single band with relatively uniform amplitude at the band center, amplitude ripples which are worst at the band edges, and a gradual decrease in ripple amplitude towards zero outside the band. Both the intensity and location of the ripples as well as the sharpness of the band edges depend on the sweep parameters (sweep rate, start and stop frequencies) in such a manner that arbitrarily sharp band edges and low ripple cannot be achieved at the same time. In addition, sweep excitation necessarily excites all ions with resonant frequencies between the sweep start and stop frequencies and thereby does not allow selective excitation of ions with only certain ranges of m/z values. Such broad band excitations also cannot be used to eject ions of all but one or a few selected m/z values.

Another ion excitation method for FTMS is based on sinusoidal bursts and may be denoted pulse sequence excitation. A sequence of sinusoidal bursts is constructed with the frequency, phase, and starting time of each burst such that the amplitude spectrum of the sequence approximates the desired excite amplitude spectrum. High selectivity is possible for simple spectral shapes, but it is difficult to construct pulse sequences to approximate arbitrary excite spectra.

Impulse excitation consists of a single narrow pulse. This method is broadband only, so no selectivity is possible. Also, very high voltages are required to deliver sufficient energy to the ions, due to the short time duration of the pulse. Pseudo-random noise excitation uses a white noise sequence to excite ions over a wide mass range. No selectivity is possible with this method either, but much lower voltages are required than for impulse excitation.

An improved technique for tailoring the excite amplitude spectrum to excite ions of particular m/z values is set forth in U.S. Pat. No. 4,761,545 to Marshall et al., entitled Tailored Excitation For Trapped Ion Mass Spectrometry, the disclosure of which is incorporated herein by reference. This method, which may be denoted as stored waveform inverse Fourier transform excitation, takes an arbitrary excitation amplitude spectrum and inverse Fourier transforms it to give a time domain waveform. This waveform is then used as the excitation signal. There are two inherent problems with this method.

The first difficulty is that the resulting time domain waveform has a very high peak-to-average power ratio, particularly when the starting excite amplitude spectrum is broadband. This requires the use of power amplifiers with impractically large output voltages to achieve adequate ion orbital radii. U.S. Pat. No. 4,761,545 uses phase scrambling to overcome this problem. A phase is assigned to each frequency in the starting excite amplitude spectrum such that a smaller number of frequencies are in phase at any point in the resulting time domain waveform. However, phase scrambling distorts the excite amplitude spectrum such that it is not possible to achieve arbitrary excite spectra and suitably low peak excitation voltages at the same time.

The second inherent problem with the stored waveform technique is that if there exist any discontinuities in the starting excite spectrum or in any order derivative of this spectrum, truncating the resulting time domain waveform to finite length introduces Gibbs oscillations into the corresponding excite amplitude spectrum. These amplitude fluctuations can be quite large and limit the excite selectivity to an unacceptable level. This problem is frequently encountered in the field of digital signal processing, and the accepted solution is to truncate the time domain waveform gradually on both ends by multiplying it by a window function (apodizing function). A window function has a value of zero at both ends, a value of one in the center and varies smoothly in between. This removes the Gibbs oscillations, but if applied to a stored waveform which has been phase scrambled, it can cause severe distortion of the excite spectrum. Thus, windowing and phase scrambling, as described above, often cannot be used concomitantly.

SUMMARY OF THE INVENTION

In accordance with the principles of the present invention, the user specifies a desired mass domain excitation profile (excited ion orbital radius vs. m/z value) to achieve excitation to specified orbital radii of those ions with certain m/z values while not exciting ions with other m/z values. This excitation profile may be of arbitrary shape and may include discontinuities. A profile, in general, consists of one or more mass excitation bands, whose orbital radii are independent and not necessarily constant, separated by mass bands with no excitation. The user also specifies to what degree the resulting excitation profile must approximate the desired profile, since to exactly achieve it requires, in general, an infinitely long time domain waveform. This constraint is conveniently expressed as the minimum required excite resolution, and is equivalently expressed in either mass or frequency terms. From the excitation profile and resolution constraint, calculations are made of the number of data points needed in each of the subsequent Fourier transform steps, the length of the window function, the number of appended zeros and the amount of phase scrambling required.

The desired mass domain excitation profile is then converted to a discrete excite amplitude spectrum (voltage spectral density vs. frequency) in which frequency is approximately inversely proportional to m/z and voltage spectral density is proportional to orbital radius. From this spectrum, a time domain waveform is produced suitable for ion excitation by both direct and iterative methods.

Using the direct method of the invention, the desired excite amplitude spectrum is inverse Fourier transformed to produce a time domain waveform. Due to the time domain data ordering of most Fourier transform algorithms, it is usually necessary to circular time shift the waveform by half its length so that the points of maximum magnitude are in the center and thus suitable for windowing. The shifted waveform is multiplied by a variable length window function to reduce Gibb's oscillations in the excite amplitude spectrum. A sufficient number of zeros are then appended to both ends of the waveform to avoid distortion in the subsequent phase scrambling step. The windowed time domain waveform with appended zeros is then Fourier transformed to produce a windowed excite amplitude spectrum. This spectrum is then phase scrambled by assigning a phase to each frequency point to reduce the peak voltage in the resulting time domain waveform. The phase-scrambled spectrum is then inverse Fourier transformed and time shifted by half its length to produce a time domain waveform which, after appropriate scaling, is suitable to generate the excitation electric field in the ICR cell.

This invention offers several important advancements over prior art methods. First, it is now possible to do phase scrambling without distorting the excite amplitude spectrum. Therefore, it becomes practical to use whatever amount of phase scrambling is required to lower the time domain waveform peak voltage to any desired level. Second, it is now possible to use both windowing and phase scrambling together without distorting the excite amplitude spectrum. This enables reducing Gibb's oscillations in the excite amplitude spectrum while still using any desired amount of phase scrambling. Excite amplitude spectra demanding high excite selectivity, lack of ripples and large peak voltage reductions can now be achieved. Third, it is now possible to describe the desired excitation directly in terms of m/z and orbital radius (kinetic energy), fundamental quantities widely understood by mass spectrometrists. Prior art stored waveform and sweep excite methods required the use of a repetitive trial-and-error approach to achieve desired orbital radii. Since most trapped ion mass spectrometers do not have a convenient, direct way to measure orbital radius, this is problematic. Fourth, the peak time domain waveform voltage resulting from a given desired mass domain excitation profile and the amount of phase scrambling required to reduce this peak voltage to any given level can now be predicted. Prior art stored waveform methods required a trial-and-error approach for this as well. Fifth, since the excited ion orbital radii are predictable, it is possible to convert the intensity of the received signal at each frequency into the number of ions at each m/z value. This quantity is of great interest to mass spectrometrists, but has not been implemented on prior art trapped ion mass spectrometers due to uncertainty in the ion orbital radii.

Similar results are obtained using the iterative method of the invention. For this method, the user must specify an additional parameter, the convergence constraint, which sets a limit on the allowable deviation from a reference excite amplitude spectrum. First, the desired excite amplitude spectrum is inverse Fourier transformed and the resulting time domain waveform shifted by half its length as in the direct method. This time domain waveform is then multiplied by a window function and then Fourier transformed to produce the reference excite amplitude spectrum. This spectrum is a lower resolution (smoothed) version of the desired excite amplitude spectrum.

A copy of the (original) desired excite amplitude spectrum is used as the working spectrum for the first pass. The working spectrum is then phase scrambled to reduce the peak voltage in the resulting time domain waveform. The phase-scrambled working spectrum is inverse Fourier transformed and time shifted half of its length to produce a time domain waveform. The waveform is multiplied by the same window function used to create the reference spectrum. The windowed waveform is then Fourier transformed to produce an output spectrum. The prior steps of phase scrambling and windowing result in distortion of the output spectrum compared to the reference spectrum, just as in prior art stored waveform techniques. If the output spectrum matches the reference spectrum to within the error specified by the convergence constraint, then the windowed time domain waveform is suitable to generate the excitation electric field in the ICR cell.

Otherwise, the magnitude of each frequency component in the working spectrum is predistorted by an amount related to and in the opposite direction of the distortion of that frequency component in the output spectrum, and the above algorithm is repeated until the convergence constraint is met. This describes a deconvolution method, and any function commonly used in such methods can be used to predistort the working spectrum.

The ion cyclotron resonance apparatus of the present invention may be utilized with any of the various available ion cyclotron resonance cells which typically include excitation plate electrodes, detection plate electrodes, and trapping end plates. The signals from the excited ions in the cell are detected, amplified, and then analyzed by a control computer in the usual fashion using well-known Fourier transform techniques. A time domain waveform resulting from either the direct or the iterative methods described is downloaded to the digital waveform memory in the apparatus of the invention. Control and timing information is downloaded as well, specifying how many words the waveform occupies, what the output rate is, when it is to begin outputting, and what positions the various switches must be in. During excitation, the digital data from the memory is delivered in a desired time sequence to a digital-to-analog converter which generates an analog representation of the time domain waveform. The analog waveform, suitably amplified, may be directly provided to the excitation plates of the ICR cell. Alternatively, the analog signal may be mixed with a first higher frequency carrier signal to generate a modulated signal which is then provided to the excitation plates of the ICR cell. Correspondingly, the output signal from the detection plates of the cell is then mixed with a second high frequency signal to provide a mixed signal which may be low-pass filtered to pass the difference frequency portion of the mixed signal to an analog-to-digital converter which feeds the digitized information to the computer for Fourier transform analysis.

Although it is preferred that the excitation signal be applied to the excitation side plates of the ICR cell, it is possible to obtain ion selective excitation or ejection by applying the excitation signal, tailored in accordance with the present invention, to the end plates of the ICR cell.

The principles of the present invention may be further extended to utilization with ion-trap devices, which are similar to ICR cells but generally have hyperbolically curved rather than flat or circular side plates and a different curvature for the end plates than for the side plates. Such ion trap devices operate in the absence of an applied magnetic field and store ions over a mass range determined by the magnitudes of radio frequency and DC voltages applied to the plates of the ion trap. By applying a time domain waveform to the end plates of the ion trap, generated in accordance with the present invention from a tailored frequency domain spectrum, it is possible to eject selected ions longitudinally from the ion trap by exciting the selected mass dependent trapping frequencies, thereby ejecting those ions having specific mass-to-charge ratios.

Further objects, features, and advantages of the invention will be apparent from the following detailed description when taken in conjunction with the accompanying drawings.

DESCRIPTION OF THE PREFERRED EMBODIMENT

Figure 1:
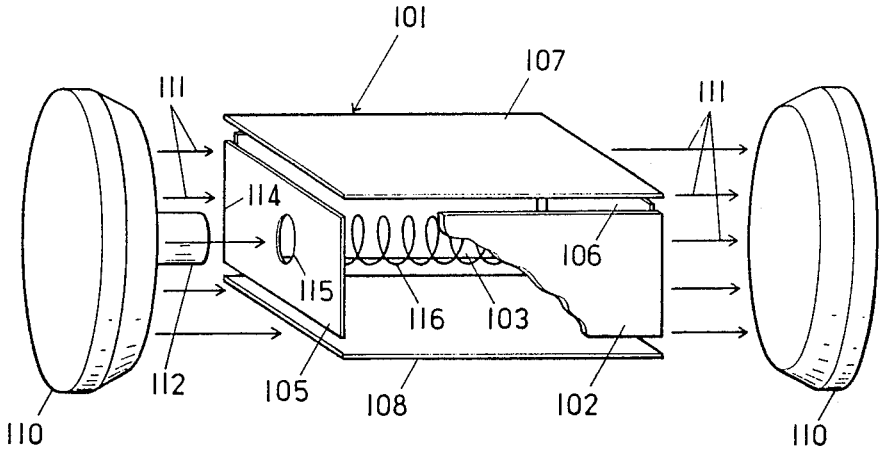
FIG. 1 is a simplified view of an ion cyclotron resonance cell to which excitation signals of the present invention may be applied.

With reference to the drawings, a schematic perspective view of an exemplary ion cyclotron resonance cell is shown generally at 101 in FIG. 1. As is well-known in the art, the ion cyclotron resonance (ICR) cell 101 would be enclosed in an evacuable chamber (not shown) and a vacuum pump (also not shown) and other ancillary equipment standard for ICR cells would be utilized to achieve the desired low pressure in the cell. After the cell has been pumped down to the desired pressure, a gas sample to be analyzed may be introduced into the cell or adjacent to it from a suitable source in a manner well-known in the art. For purposes of illustration, the ICR cell 101 is shown as having a substantially rectangular cross-section, a parallelepiped form, with opposed side plates 102 and 103 serving as excitation electrodes, end trapping plates 105 and 106, and top and bottom plates 107 and 108, respectively, which may serve as detector electrodes. Various other geometric configurations for ICR cells, such as cylindrical or hyperbolic forms, multiple sets of plates, etc., are known and may also be utilized. The ICR cell 101 is maintained in a substantially constant and preferably uniform magnetic field of flux density B produced by an electrical (or permanent) magnet 110 of any suitable construction, with the field direction being oriented longitudinally, generally between the end plates 105 and 106, as represented by the lines of flux labeled 111. It is understood that other magnet configurations may also be used, including a solenoid magnet which surrounds the ICR cell.

Various means of producing ions in the cell 101 are well known and may be used. For purposes of illustration, an ion generating source 112, such as an electron gun, a laser, or other source of ionizing energy, may provide a beam 114 which passes through an opening 115 in the front end plate 105 and causes ionization of gas (or solid) molecules within the cell, although the ions may also be formed outside the cell and then transferred inside using techniques well known in the art. These ions are constrained to move in a cycloidal path 116 within the ICR cell 101 by interaction with the constant magnetic field and are trapped within the cell by bias voltages applied to the trapping end plates 105 and 106 of the cell. The construction details and operation of ICR cells are well-described elsewhere in various technical papers and patents, for example, in the foregoing Comisarow, et al. patent and the Marshall, et al. patent, both incorporated herein by reference, and need not be further described here to illustrate the present invention.

Figure 2:
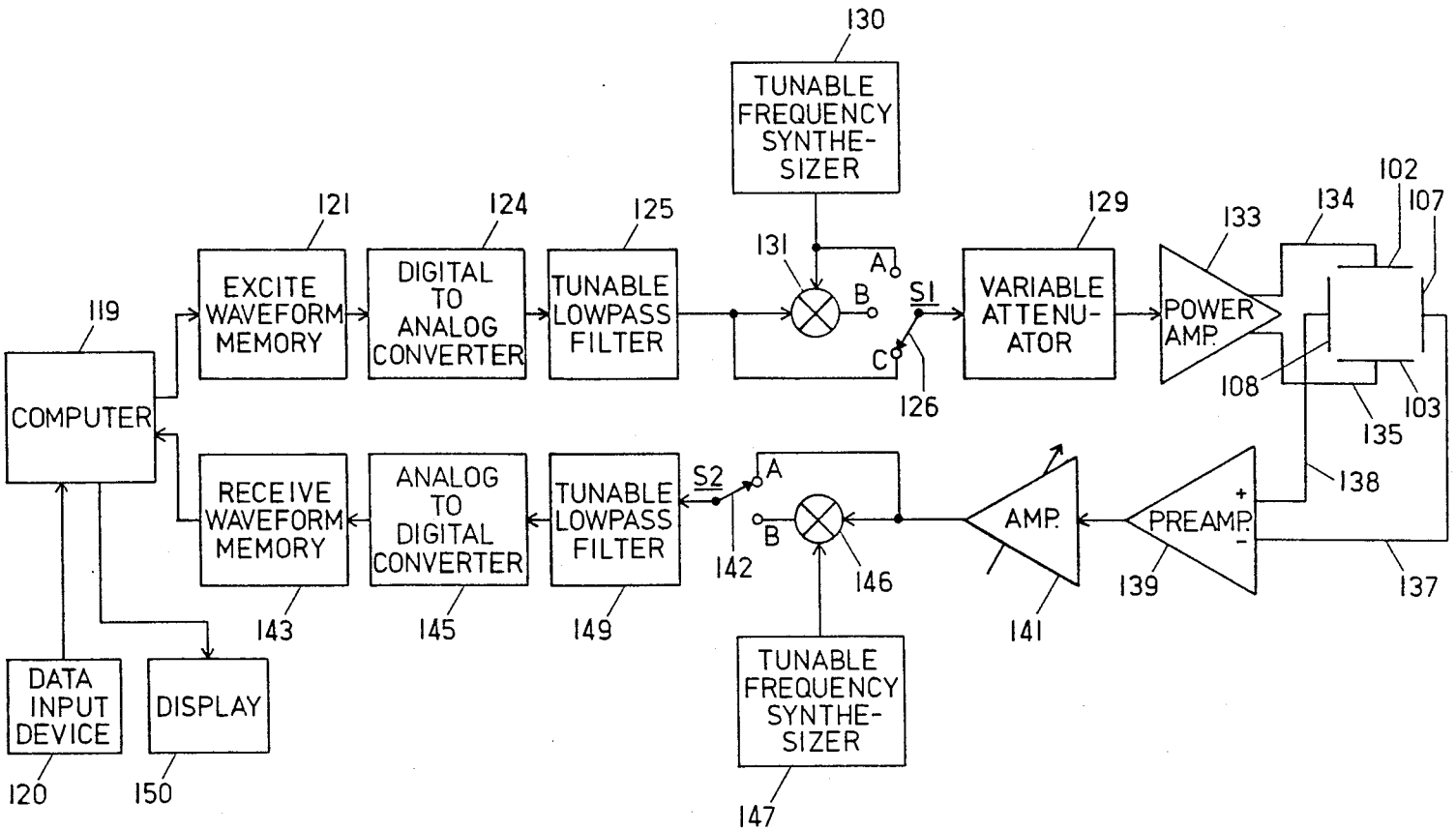
FIG. 2 is a block diagram of an ion cyclotron resonance mass spectroscopy system incorporating the present invention.

A block diagram of an ion cyclotron resonance mass spectroscopy system embodying the present invention is shown in FIG. 2. A data input device 120, e.g., a keyboard, mouse, interactive graphics unit, or a magnetic media reader, receives data from the operator indicating the selected mass domain excitation profile (or corresponding excitation amplitude spectrum) which the operator has determined will best suit the mass spectroscopy analysis he wishes to perform. The data received by the data input device 120 is provided to a programmable digital computer 119, e.g., a Nicolet 1280 computer incorporated in a Nicolet Instrument Corporation FTMS-2000 instrument, which carries out either the direct or iterative methods described below, or uses some other method in accordance with described principles of this invention. The stored inverse Fourier transform waveform is written into a digital memory 121. Under the control of the computer 119, the data from the memory may be read out to a digital-to-analog converter 124 which provides an analog output signal to a tunable low pass filter 125 which filters out frequencies in the analog signal which are above the frequencies of interest. In other words, the filter 125 functions as an output anti-aliasing filter. For example, for stored waveform direct mode operation as described further below, the excitation amplitude spectrum may have a bandwidth of 1 MHz and the stored waveform may have a Nyquist rate of 1.5 MHz. The filter may then be set to have a cut-off above a frequency between 1 MHz and 1.5 MHz to pass the full bandwidth of the signal and to attenuate aliased frequencies and noise outside that bandwidth. The system can also operate in a heterodyne mode in which the filter 125 would reject only frequencies above the (baseband) stored waveform bandwidth (for example, 100 kHz). In the direct mode, a switch 126 is set in position C, as shown in FIG. 2, such that the output of the filter 125 directly connects to a variable attenuator 129 which is programmable to attenuate the signal by up to 64 dB in 0.1 dB steps. Alternately, the system can operate in the heterodyne mode in which a first high frequency carrier signal is provided from a tunable frequency synthesizer 130 under the control of the computer 119 to a mixer 131 and wherein the switch 126 is switched to position B in which it provides the output signal from the mixer 131 to the variable attenuator 129. The output of the mixer 131 contains a double side-band amplitude modulated signal centered on the output frequency of the tunable frequency synthesizer 130. The output of the attenuator 129 is supplied to a power amplifier 133 which delivers the time varying voltage output signal on the lines 134 and 135 to the excitation electrodes 102 and 103, respectively, with the signals on the lines 134 and 135 being 180 degrees out of phase with one another. The time varying voltage applied to the plates 102 and 103 produces a corresponding time varying electric field in the ICR cell which is oriented transverse to the applied magnetic field.

As explained further below, the signal supplied to the plates 102 and 103 excites various resonant responses in the ions within the cell. These responses are detected as image currents induced on one or both of the detector plates 107 and 108, and these currents are transmitted on lines 137 and 138 to a preamplifier 139 where the image currents are converted to voltages and amplified. The output signal from the preamplifier 139 will be a time varying signal having frequency components indicative of the particular ions that have been excited by the time varying electric field previously applied to the ions in the cell. The output signal from the preamplifier 139 is directed to a variable gain amplifier 141 which provides its amplified output both to a switch 142, which is positioned for either a direct or heterodyne mode of operation, and to a mixer 146. In the direct mode (switch position A), as shown in FIG. 2, the output of the amplifier 141 passes through the switch 142, to the tunable lowpass (anti-aliasing) filter 149, then to the analog-to-digital converter 145 which digitizes the signal and provides the digitized data to the receive waveform memory 143 and finally to the computer 119. Alternately, if the heterodyne mode of operation is chosen, the switch 142 is set to position B to provide the signal from the mixer 146, which also receives a second high frequency input signal from a tunable frequency synthesizer 147. The mixing of the output signal of the amplifier 141 and the signal from the synthesizer 147 results in an output from the mixer having sum and difference frequency components. It is apparent that the second high frequency carrier signal from the synthesizer 147 may be at a frequency different from the frequency of the first carrier signal from the synthesizer 130, although the two frequencies may also be equal under appropriate conditions. The low pass filter 149 then passes just the difference frequency components to the analog-to-digital converter 145. The digital data from the converter can be stored in a receive waveform digital memory 143 for later processing by the computer 119, and a fast Fourier transform may be performed on the data to provide an output display on a display device 150, e.g., a CRT screen or a laser printer, which is indicative of the frequency spectrum or the mass-to-charge ratio spectrum of the detected signal from the ICR cell.

Figure 3:
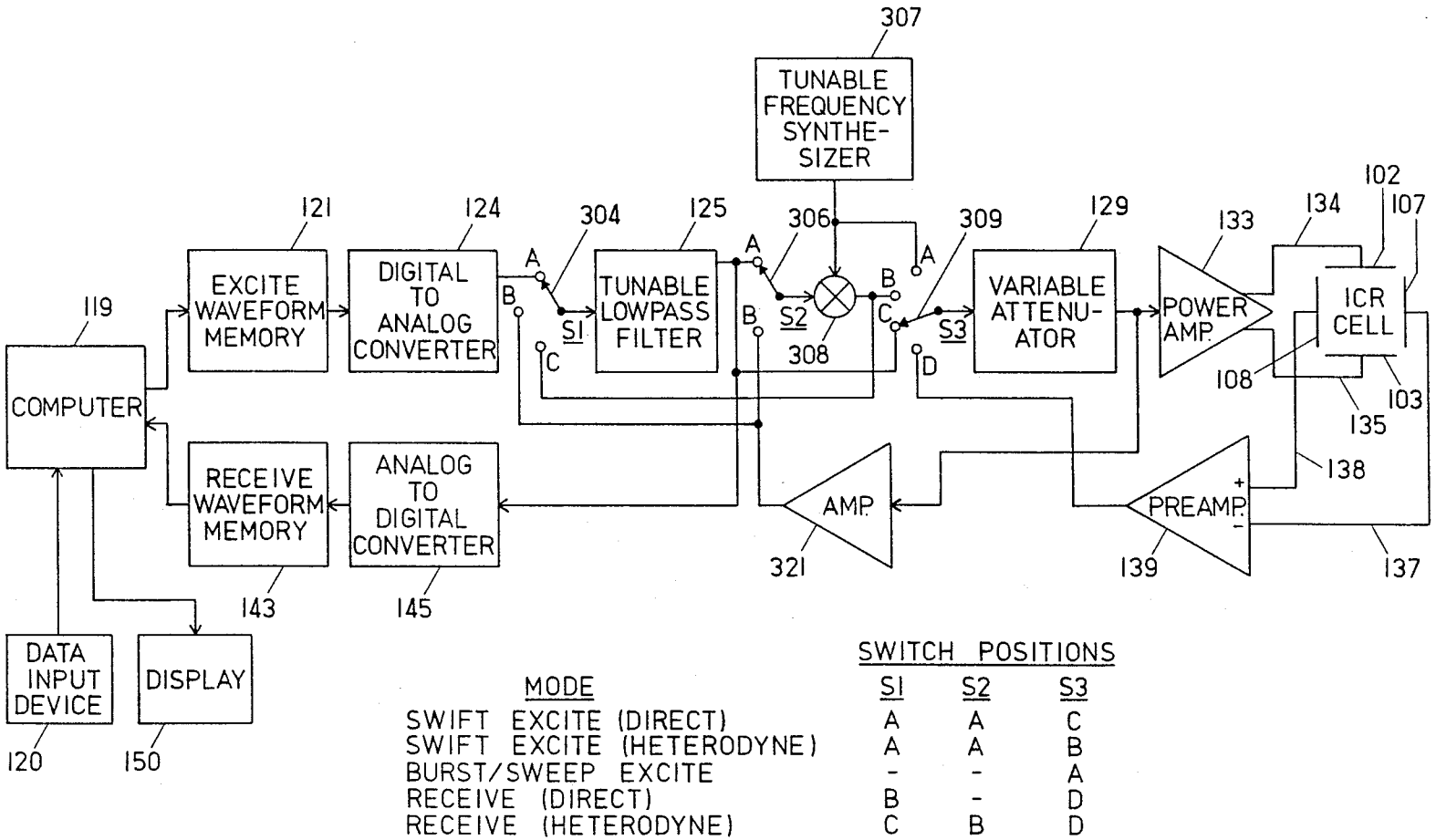
FIG. 3 is a block diagram of a somewhat simplified version of the system of FIG. 2.

FIG. 3 is a block diagram of a somewhat simplified system that is essentially functionally equivalent to the system in FIG. 2 except that excitation and reception cannot occur simultaneously. The tunable frequency synthesizer 307 functions in both the excite and receive paths, so it replaces the two synthesizers 130 and 147 in FIG. 2. Likewise, the single mixer 308 of FIG. 3 replaces the two mixers 131 and 146 of FIG. 2 and the single tunable lowpass filter 125 of FIG. 3 replaces the two tunable lowpass filters 125 and 149 of FIG. 2. A fixed gain amplifier 321 (64 dB gain) in FIG. 3 replaces the variable gain amplifier 141 in FIG. 2 because the fixed gain amplifier 321 can make use of the variable attenuator 129. The chart in FIG. 3 shows how the switches 304 (S1), 306 (S2) and 309 (S3) would be set for operation in various modes.

The present invention allows computation of a stored waveform that requires arbitrarily low peak excitation voltage and whose excite amplitude spectrum has arbitrarily low deviation from a desired excite amplitude spectrum. It also permits calculation of stored waveforms from specifications in terms of m/z and orbital radius. This involves several new principles which are incorporated into two practical methods for the computation of the stored waveform.

The first principle is distortionless phase scrambling. In prior phase scrambling, a preferred procedure was to assign a phase to every frequency such that after inverse Fourier transformation, the different frequency components would be maximally dephased at each instant in the time domain waveform. A closer look at the process reveals that a non-constant phase function has a non-zero group delay associated with it. Group delay is the negative of the derivative of phase with respect to frequency, and corresponds to the time shift (away from zero time) experienced by the energy at a particular frequency after inverse Fourier transformation. For discrete time waveforms, the time shift is circular. Since stored waveforms are necessarily discrete time, a circular time shift in the energy of any frequency component will shift non-zero values to the ends of the waveform. These discontinuities cause Gibbs oscillations to appear in the excite amplitude spectrum around that frequency component. The more severe the phase function (and thus the more effective in lowering the peak excitation voltage), the larger the time shift and thus the more severe the Gibbs oscillations.

The principle of distortionless phase scrambling insures that any part of the stored waveform that is shifted to the ends of the waveform due to non-zero group delay will have zero amplitude. In this manner, there are no discontinuities and Gibbs oscillations do not occur. One means of accomplishing this is to inverse Fourier transform the excite amplitude spectrum, then multiply the resulting time domain waveform by a window function, append extra zero points to both ends of the windowed function, and forward Fourier transform the result. Windowing followed by appending extra zeros may be thought of as using a modified window function that has the value of zero not just at the end points of the interval but for a segment at each end, and thus may be called an "expanded" window function. This allows the phase function to have group delays up to the length of a zero segment of the expanded window function without causing discontinuities at the ends of the stored waveform and thus no Gibbs oscillations. In prior art stored waveform methods, windowing and phase scrambling could not always be used together due to distortion in the resulting excitation amplitude spectrum. Windowing is desirable even if no phase scrambling is used since a finite length stored waveform is necessarily truncated and thus has discontinuities at its end.

The second principle is optimal phase scrambling. An optimal phase function is one which provides, for an arbitrary excite amplitude spectrum, the maximum reduction in peak excitation voltage for the resulting stored waveform without distorting the excite amplitude spectrum. The goal of phase scrambling is to spread out the excite energy as evenly as possible in the stored waveform. Since an arbitrary excite amplitude spectrum possesses energy in arbitrary amounts at various frequencies, the optimal phase function must be dependent on the excite amplitude spectrum. Prior art phase scrambling techniques use a selected fixed phase function, which may not perform well for arbitrary excite amplitude spectra.

For optimal phase scrambling with an arbitrary excite amplitude spectrum, it is necessary to spread the power from each frequency region of the spectrum over a time region whose width is proportional to the amount of that power. Mathematically, let the group delay at each frequency be proportional to the fraction of the total spectral power contained in the integral of the power spectrum up to that frequency. If the end segments of the expanded window function are each k seconds long, then $$t_d(\omega)=mD(\omega)+b$$

where $t_d(\omega)$=group delay (seconds)
k=maximum group delay (seconds)
m=slope=2k
b=offset=−k $$D(\omega)=\frac{\int_0^{\omega} S(X)\,dX}{\int_0^{\omega_s/2} S(X)\,dX}$$

$\omega$=frequency (radians/sec)
$\omega_s$=sampling frequency (radians/sec)
$S(X)=|F(jX)|^2$.
F(jX)=excite voltage spectral density (V/Hz)
$j=(-1)^{\frac{1}{2}}$
X=dummy frequency variable Using as the definition of group delay the negative of the derivative of phase with respect to frequency, integrating to get phase and converting to the discrete frequency domain yields:

$$\theta\left(n\frac{\omega_s}{N}\right)=\frac{4\pi n_d}{N\sum_{P=0}^{N/2} S_d\left(\frac{P}{N}\omega_s\right)}\left[\sum_{L=0}^{n}\sum_{K=0}^{L} S_d\left(\frac{K}{N}\omega_s\right)\right]-\frac{2\pi n_d}{N}n \qquad \text{(eqn. 1)}$$

where $\theta\left(n\frac{\omega_s}{N}\right)$= phase (radians)

n=integer frequency index
$n_d$=number of group delay points each end
N=total number of data points
$S_d(X)=|F(jkX)|^2$
$F_d(jkX)$=discrete excite voltage spectral density (V/Hz)

It is also possible to predict what reduction in peak excitation voltage will result from optimal phase scrambling with a given maximum group delay. Conversely, it is possible to compute what minimum group delay is required for phase scrambling to reduce the peak excitation voltage to any given level. This minimum group delay becomes the minimum length of the zero segments of the expanded window function.

To predict the peak voltage in the windowed time domain waveform corresponding to the desired excite amplitude spectrum without phase scrambling, first assume a continuous excite amplitude spectrum with a single band of constant magnitude A for $-\omega_c<\omega<\omega_c$. The peak voltage in the inverse transform is $A\omega/\pi$, which is the integral of the spectrum divided by $2\pi$. For multiple spectral bands, the peak voltages simply add since the phases are all 0 at t=0. Therefore, $$Vp=\frac{\int_{-\infty}^{\infty}|F(j\omega)|\,d\omega}{2\pi} \qquad \text{(eqn. 2)}$$

where

Vp=time domain waveform peak voltage
F(jω)=excite voltage spectral density (V/Hz)
$j=(-1)^{\frac{1}{2}}$
ω=frequency (radians/sec)

Subsequent windowing does not affect Vp because the window function has the value 1 when the time domain waveform has the value Vp. If we assume that the minimum required excite resolution is set high enough to cause the spectrum of the windowed time domain waveform to be a good approximation of the desired excite amplitude spectrum, then windowing will not affect Vrms significantly, either. Using this approximation, the rms value of the windowed time domain waveform, using Parseval's theorem, is $$Vrms=\sqrt{\frac{\int_{-\infty}^{\infty}|F(j\omega)|^2 d\omega}{2\pi T_1}} \qquad \text{(eqn. 3)}$$

where

Vrms=time domain waveform rms voltage
$T_1$=window function center segment length (sec)

The optimal phase scrambling function given in equation 1 causes the time domain waveform to have an envelope that is relatively flat in the center and has the shape of the respective half of the window function at each end. To estimate the peak time domain voltage after optimal phase scrambling, we make two assumptions. One is that the rms value of the flat center section is equal to that of a sinusoid of the same peak voltage. The second is that the rms value of the two windowed end sections are related to the rms value of the windowed time domain waveform before phase scrambling directly by the ratios of their peak voltages. Solving the equations for this making use of equations 2 and 3 gives the relation.

$$T_2=2\int_{-\infty}^{\infty}|F(j2\pi f)|^2 df\left[\frac{1}{Vp_2^2}-\left(\frac{1}{\int_{-\infty}^{\infty}|F(j2\pi f)|\,df}\right)^2\right]+T_1 \qquad \text{(eqn. 4)}$$

where $T_2$=total length of phase scrambled time domain waveform (seconds)
$Vp_2$=peak time domain voltage after optimal phase scrambling (Volts)
f=frequency (Hertz)

The time domain waveform is longer by $T_2-T_1$ seconds after phase scrambling. Equation 4, then, shows how much optimal phase scrambling to use to reduce the peak time domain voltage to $Vp_2$ volts.

The third principle of the present invention is minimization of required window width. Application of the principle of distortionless phase scrambling involves using a window function. This avoids Gibbs oscillations but also reduces the resolution of the excite amplitude spectrum by acting as a smoothing filter. Fortunately, this can be countermanded to any required degree by making the center part of the expanded window function wider in time. As the window function gets wider, the resulting resolution increases since the stored waveform becomes longer. The resolution is directly proportional to the width of the non-zero (center) portion of the expanded window function. Given some constraint as to how closely the resulting excite amplitude spectrum must approximate the desired one, it is possible to compute the minimum required window width.

One convenient method of stating the deviation constraint is minimum required excite resolution, expressed as full width at half height (FWHH) of an isolated peak or as full width at 10% valley of an unresolved peak pair. Mass spectrometrists commonly express resolution as the ratio of the m/z value at the center of the peak to the peak width in m/z at the specified fraction of the peak height. This is easily converted to peak width in Hertz by commonly used methods. The FWHH for a variety of window functions has been tabulated. The minimum window width for the Blackman-Harris window function to achieve a given FWHH is $$T_1 = 2.35/FWHH \quad \text{(eqn. 5)}$$

where $T_1$ = minimum window center segment width (sec),

FWHH = minimum width of an isolated excite amplitude spectrum peak (Hz)

While the minimum required excite resolution is a convenient way to express the maximum allowed deviation constraint, there are many other suitable parameters that could be used. These include, but are not limited to, maximum error at excite band centers, maximum error at excite band edges, excite band edge transition width and total rms error.

In order to convert ion orbital radius to excite voltage spectral density, first note how ion orbital radius relates to excite voltage spectral density for a sinusoidal burst. Assume a sinusoidal excite voltage of $f(t) = V\cos(\omega_c t)$ with duration $T_1$ applied to one excite plate and $-f(t)$ applied to the opposite plate, where V = amplitude and $\omega_c$ = radian frequency. The Fourier transform of f(t) evaluated at $\omega_c$ is $F(j\omega_c) = VT_1/2$, where $j = (-1)^{\frac{1}{2}}$. The radius achieved by an ion resonant at $\omega_c$ is $r = VT_1/Bd$, where r = radius, B = magnetic field flux density and d = distance between excite plates. Eliminating the term $VT_1$, solving for F(jw) and converting from continuous to discrete time yields.

$$F_d(jkW) = rBd/2T \quad \text{(eqn. 6)}$$

where $F_d$ (jkW) = discrete excite voltage spectral density (V/Hz)

$j = (-1)^{\frac{1}{2}}$ k = integer index value

W = frequency point spacing rad/sec r = orbital radius (meters)

B = magnetic field flux density (Webers/meter$^2$)

d = distance between excite plates (meters)

T = time point spacing (sec) The minimum number of data points in the desired excite amplitude spectrum must be at least $T_1/T$.

Figure 4:
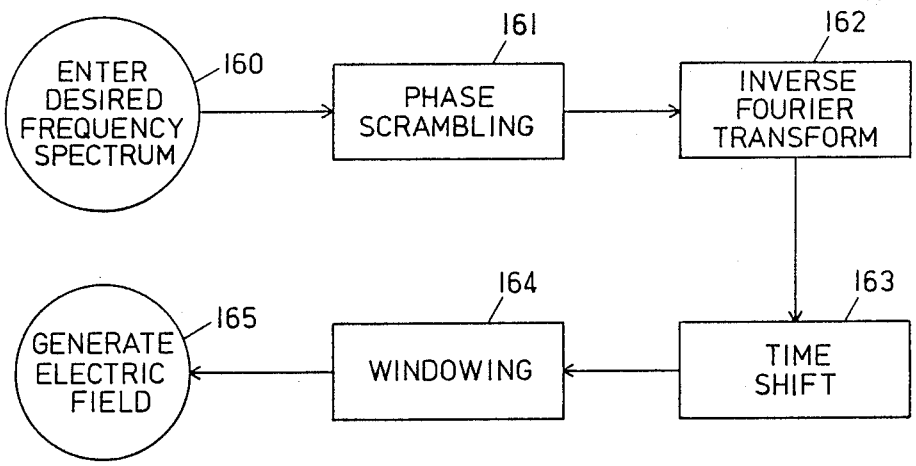
FIG. 4 is a flowchart representing the method used in the prior art.
Figure 17:
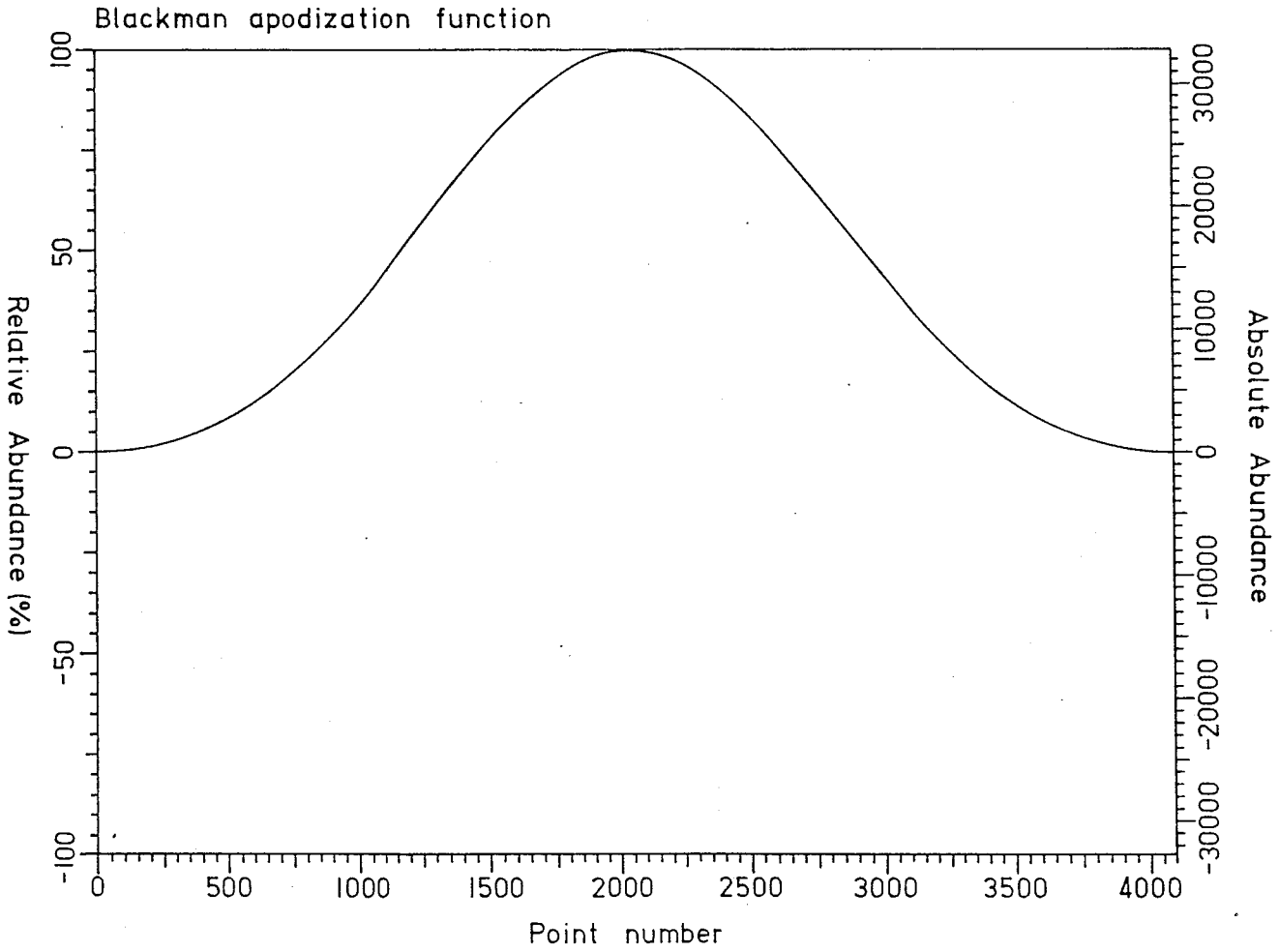
FIG. 17 is a graph showing the Blackman apodization or window function.

FIG. 4 is a flow chart showing the steps used by the prior art to produce a stored waveform used to create the electric field. First, the user provides a desired excite amplitude spectrum (frequency versus relative ion orbital radius) at block 160. Each frequency in the desired frequency spectrum provided at the block 160 is assigned a phase from one of a number of fixed phase functions, such that all frequencies are not in phase at any point in time, to produce a phase scrambled frequency spectrum at 161. The prior technique typically varied the phase as a nonlinear continuous function, such as a quadratic function of frequency. The phase-scrambled frequency spectrum is then inverse Fourier transformed to produce a time domain waveform at 162. The first half of the time domain waveform is then shifted forward in time one-half of the length of the signal, and the second half of the time domain waveform is shifted backward in time one-half of the length of the waveform (circular time shift) thereby producing a time domain waveform at 163 having a maximum value at its center. The time domain waveform at 163 is then multiplied by a window function at 164 to reduce Gibbs oscillations. A suitable window function is the Blackman function shown in graphical form in FIG. 17. The windowed time domain waveform is used to create a corresponding electric field at 165 in the ion cell.

The prior art method reduces the peak voltage required to produce a given excite amplitude spectrum through phase scrambling the frequency spectrum, which may introduce a significant level of distortion in the excite amplitude spectrum. The windowing of a time domain waveform corresponding to a phase scrambled frequency spectrum introduces further distortion into the excite amplitude spectrum. These distortions are often of sufficient magnitude that they become the limiting factor in the ability of the apparatus to selectively excite an ion in the presence of other ions of nearly equal mass.

Figure 5:
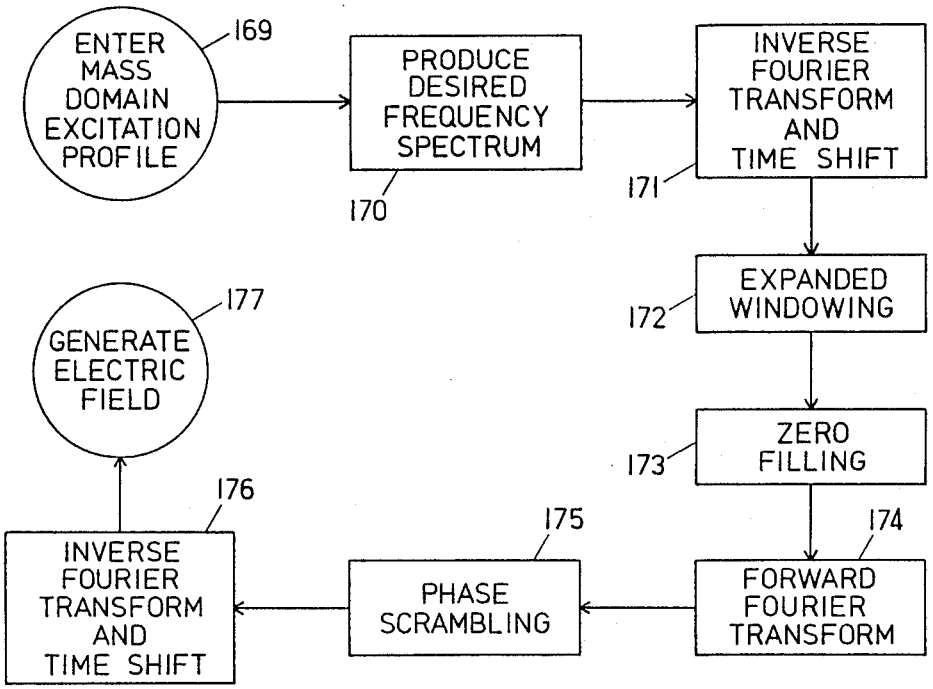
FIG. 5 is a flowchart representing the direct method of the present invention.

FIG. 5 is a flow chart representing the direct method of the present invention as carried out by the programming of the computer 119 which controls the operation of the other elements of the system. The user provides a desired mass domain excitation profile at 169 in terms of m/z and ion orbital radius. The desired frequency spectrum produced at 170 is inverse Fourier transformed and time shifted by half its length, producing a time domain waveform at 171. The resulting time domain waveform is windowed with an expanded window function at 172. If the expanded window function at 172 is wider than the time domain waveform at 171, additional zero filling is performed at 173 to correct this. The zero-filled time domain waveform is forward Fourier transformed at 174 to produce a second frequency spectrum. Each discrete frequency in the frequency spectrum is then assigned an optimal phase at 175 such that maximum reduction of peak excitation voltage is achieved without distorting the excite amplitude spectrum. The phase scrambled frequency spectrum is inverse Fourier transformed and time shifted by half its length at 176 to produce the final time domain waveform. The electric field applied at 177 in the cell is generated from this final time domain waveform.

The direct method for computing a stored waveform using the principles of the present invention therefore comprises the following steps.

(1) A desired excitation profile in the mass domain (m/z vs. excited ion orbital radius) and some parameter describing maximum allowable deviation of the resulting excite amplitude spectrum from the desired one is provided to the computer 119 at block 169.

(2) The excitation bandwidth is determined by first converting all of the m/z values to frequencies using standard FTMS calibration methods, then finding the highest frequency present. For the case of heterodyne mode stored waveform excitation, the excitation bandwidth is the difference between the highest and lowest frequencies present. Some additional bandwidth may be required to allow the output anti-aliasing filter 125 to roll off to some desired level. The output rate for the time domain waveform must be at least twice this bandwidth.

(3) The width of the non-zero (center) portion of the expanded window function required to satisfy the maximum allowable deviation parameter in step 1 is estimated from equation 5.

(4) The width of the zero (end) segments of the expanded window function required to allow enough phase scrambling to reduce the peak excitation voltage to a given level is estimated using equation 4.

(5) The requested mass domain excitation profile from step 1 is converted to an excitation amplitude spectrum (voltage spectral density versus frequency) at 170 using the results from steps 1–3 and equation 6.

(6) The resulting spectrum is inverse Fourier transformed and time shifted at 171.

(7) The resulting time domain waveform is multiplied by an expanded window function at 172 with center and end segment widths from steps 3 and 4.

(8) If the expanded window function from step 7 is wider than the time domain waveform of step 6, the result of step 7 is zero-filled at 173 to at least the width of the expanded window function of step 7.

(9) The resulting time domain waveform is forward Fourier transformed at 174.

(10) The optimal phase function for the resulting spectrum is calculated at 175 using equation 1.

(11) The resulting magnitude-phase spectrum is inverse Fourier transformed and time shifted at 176.

(12) The resulting time domain waveform is scaled for the number of bits in the output digital-to-analog converter (and for its output voltage level) to produce the resulting stored waveform.

(13) If it is desired to verify that the maximum allowable deviation parameter from step 1 has been satisfied, the stored waveform may be forward Fourier transformed.

The direct method has the advantage that the output time domain waveform computed at 176 corresponds to the undistorted desired frequency spectrum determined at 170 to any degree required. By windowing the time domain waveform with an expanded window function before phase scrambling the frequency spectrum, and by using the principles of distortionless phase scrambling, the distortion created when using the prior techniques is avoided. Furthermore, using the direct method, broad band excitations do not require peak excitation voltage that are impractically large. This allows for the excitation, detection and ejection of ions to be selectively performed, even when m/z of different ions are similar.

Figure 6:
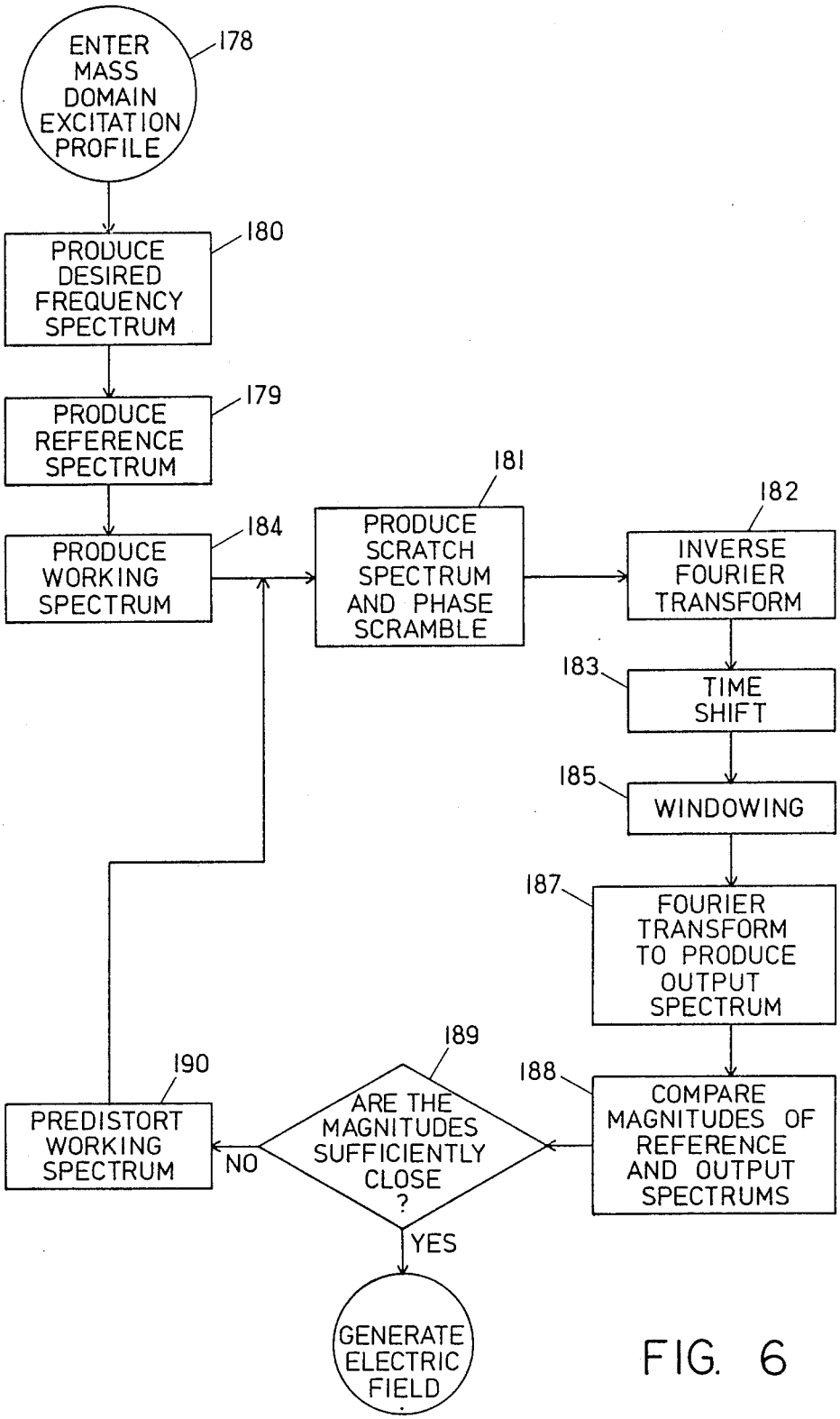
FIG. 6 is a flowchart representing the iterative method of the present invention.

FIG. 6 is a flow chart representing the iterative method of the present invention as carried out under the control of the programming of the computer 119.

The iterative method for computing a stored waveform using the principles of the present invention may typically comprise the following steps:

(11) A desired excitation profile in the mass domain (m/z versus excited ion orbital radius) and some parameter describing maximum allowable deviation of the resulting excitation amplitude from the requested one is provided to the computer 119 at block 178. Additionally, a convergence constraint must be provided.

(2) The excitation bandwidth is determined by first converting all of the m/z values to frequencies using standard FTMS calibration methods, and then finding the highest frequency present. For the case of heterodyne mode excitation, the excitation bandwidth is the difference between the highest and the lowest frequencies present. Some additional bandwidth may be required to allow the output anti-aliasing filter 125 to roll off to some desired level. The output rate for the time domain waveform must be at least twice this value.

(3) The width of a conventional window function required to satisfy the maximum allowable deviation parameter in step 1 is estimated using equation 5.

(4) The requested mass domain excitation profile from step 1 is converted to the desired excite amplitude spectrum (voltage spectral density versus frequency) at 180, using the results from steps 1–3 and equation 6.

(5) A copy of the resulting spectrum is made at block 184 and is referred to as the working spectrum.

(6) The spectrum of step 4 at block 180 is inverse Fourier transformed and time shifted by half its length at 179.

(7) The resulting time domain waveform is multiplied at block 179 by a conventional window function of a width as estimated in step 3.

(8) The resulting time domain waveform is forward Fourier transformed at 179 and the result is referred to as the reference spectrum.

(9) An optimal phase function is calculated at block 181 using a maximum group delay of less than one-half the width of the window function from step 3.

(10) A copy of the working spectrum is made, referred to as the scratch spectrum. The phase function from step 9 is appended to the scratch spectrum at block 181.

(11) The resulting magnitude phase spectrum is inverse Fourier transformed at 182 and time shifted by half its length at 183.

(12) The resulting time domain waveform is multiplied at 185 by a conventional window function of width as from step 3. This is referred to as the scratch waveform.

(13) The resulting time domain waveform is forward Fourier transformed at 187 to produce the output spectrum.

(14) The output spectrum is compared at 188 with the reference spectrum. If the convergence constraint from step 1 is satisfied, then the scratch waveform from step 12 is used as the stored waveform at 191 and the method is finished.

(15) If the convergence constraint from step 1 is not satisfied, the working spectrum is predistorted in a direction opposite to the deviation and by an amount proportional to the deviation.

(16) Go to step 10.

The iterative method has the advantage of not increasing the number of data points above those required to meet the maximum allowable deviation constraint since it uses a conventional window function instead of an expanded one. The disadvantages of the iterative method are the high computational burden and the appearance of calculation noise in the excite amplitude spectrum after several iterations. It is understood that the direct method is preferable in most cases.

Figure 7:
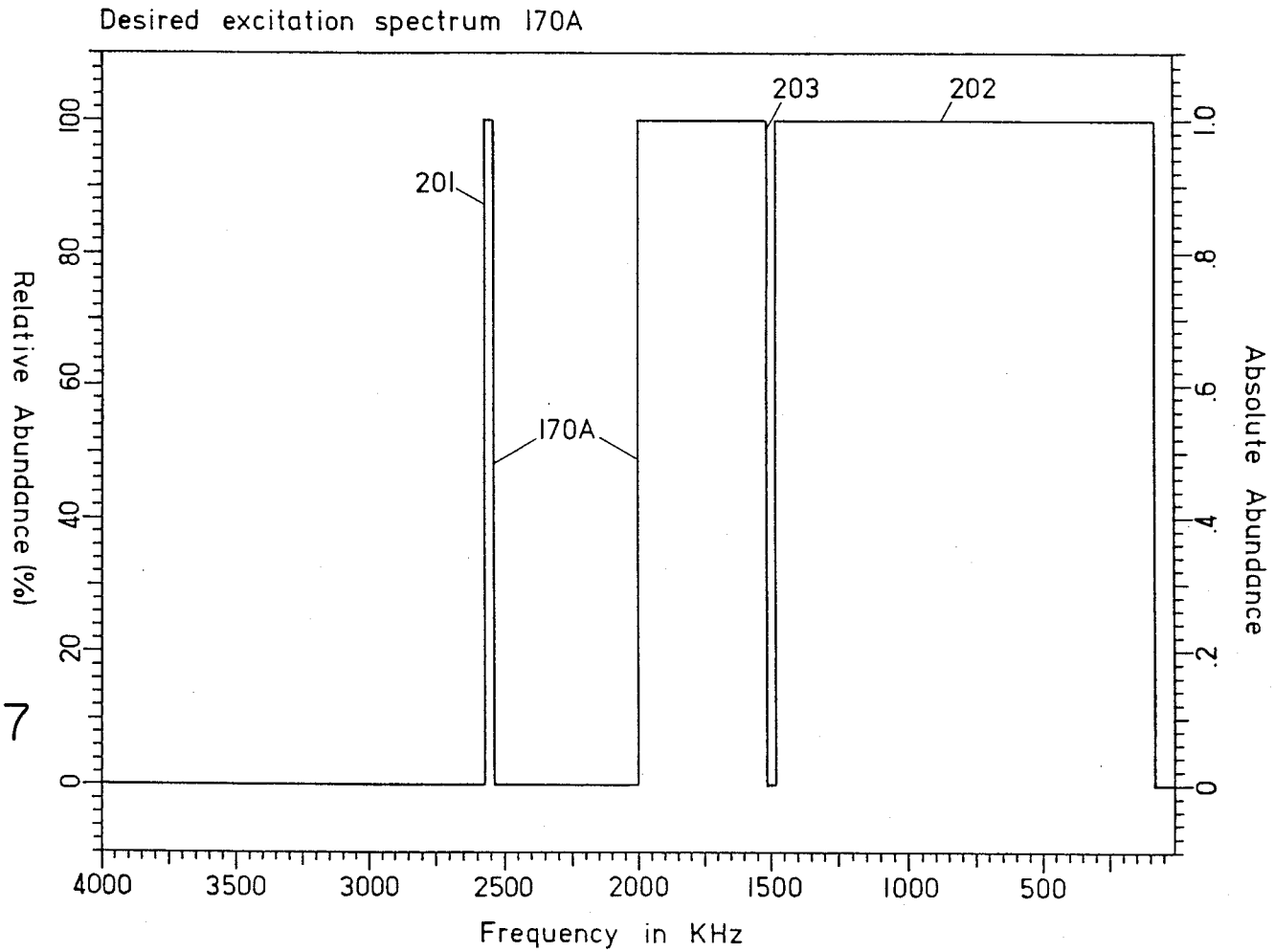
FIG. 7 is a graph showing an exemplary desired excite amplitude spectrum.
Figure 8:
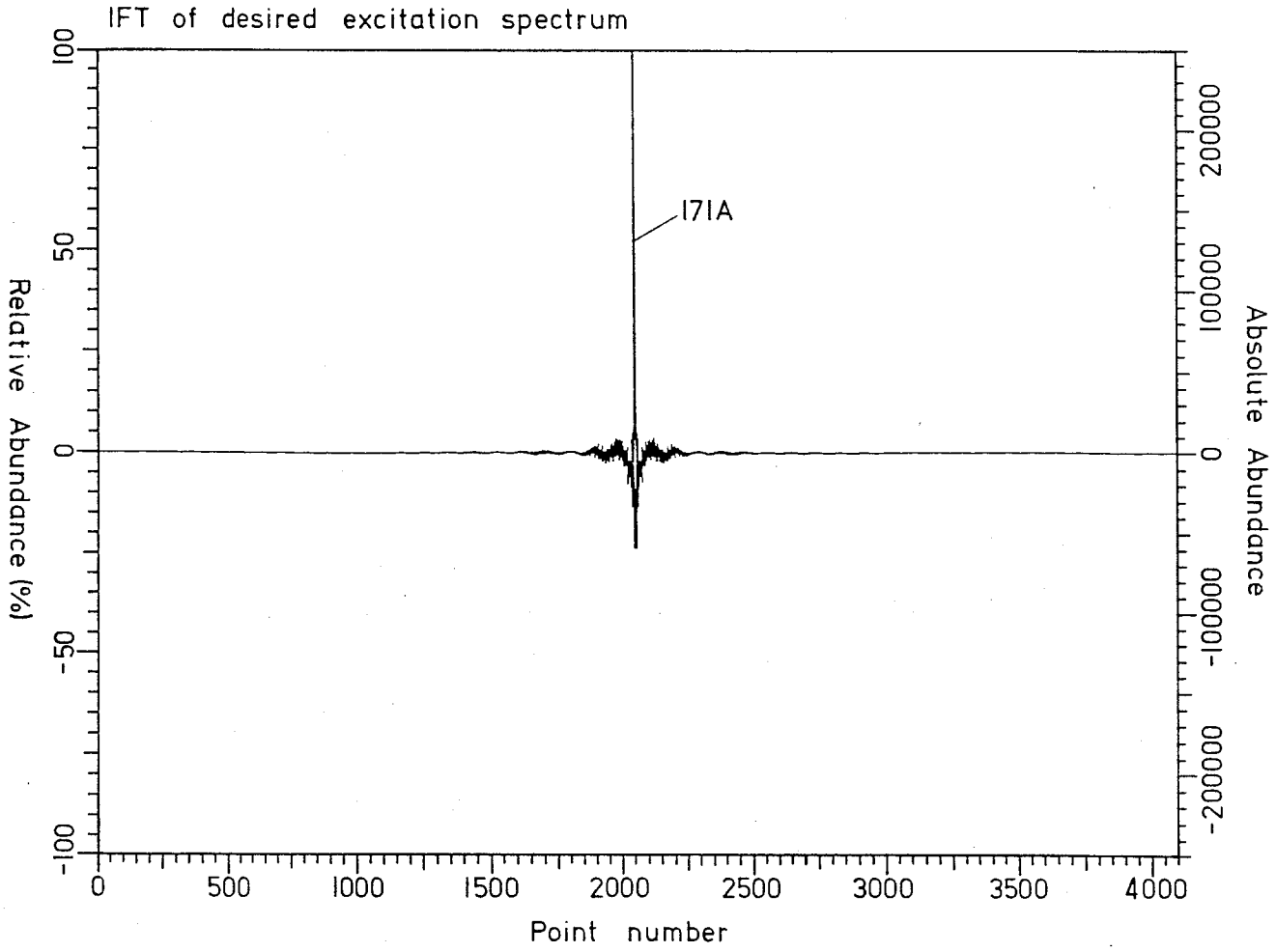
FIG. 8 is a graph showing the inverse Fourier transform of FIG. 7.

FIG. 7 is a graph showing an exemplary desired excite amplitude spectrum 170A. The spectrum has a narrow peak 201 at approximately 2550 KHz, and a broad band 202 from 100 KHz to 2000 KHz, with a narrow well 203 at approximately 1500 KHz. The magnitude of the broad band 202 and the narrow peak 201 are the same. As discussed earlier, prior excitation systems would have difficulty producing a time domain waveform that accurately corresponds to this desired frequency spectrum. First, the broad band 202 corresponds to a very narrow time domain waveform requiring an enormous amount of power. Second, the narrow peak 201 cannot be faithfully reproduced. Third, reducing Gibbs oscillations by apodizing the time domain waveform results in distortion of the output frequency spectrum corresponding to the applied time domain waveform. Each of the preceding difficulties is corrected for by the present invention. FIG. 8 is a graph showing an inverse Fourier transform at 171A of the desired frequency spectrum shown in FIG. 7. This is the first step in the direct method. Since the time signal is of finite length, Gibb's oscillations are introduced in the corresponding frequency spectrum.

Figure 9:
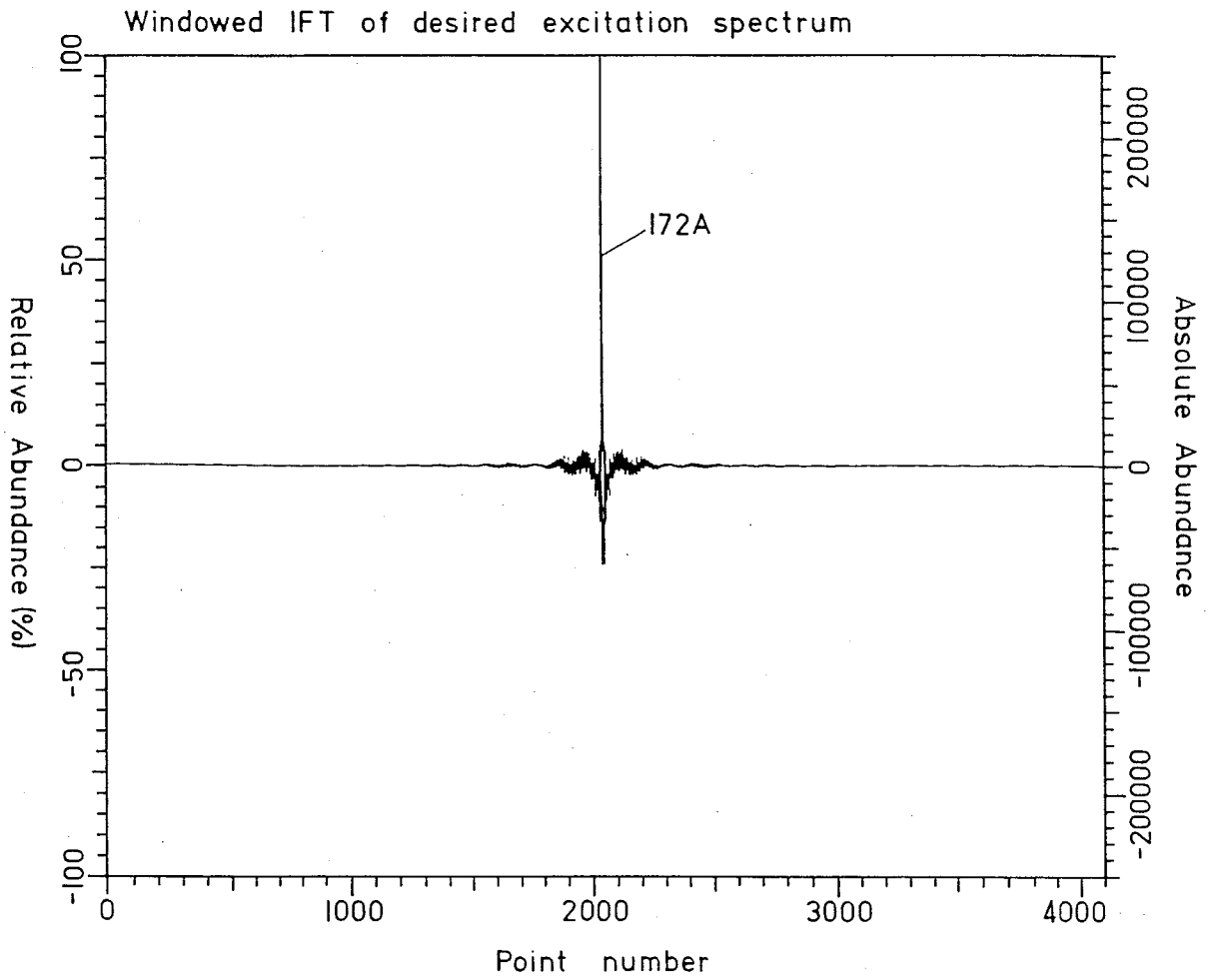
FIG. 9 is a graph showing the time domain waveform of FIG. 8 multiplied by a suitable window function.

FIG. 9 is a graph showing the windowed time domain waveform 172A, created by windowing the time domain waveform of FIG. 8. The expanded window function used was a variable width Blackmann-Harris 3-term function with zero end segments added. Windowing the time domain waveform corresponding to an in-phase frequency spectrum reduces Gibb's oscillations without distorting the corresponding frequency spectrum.

Figure 10:
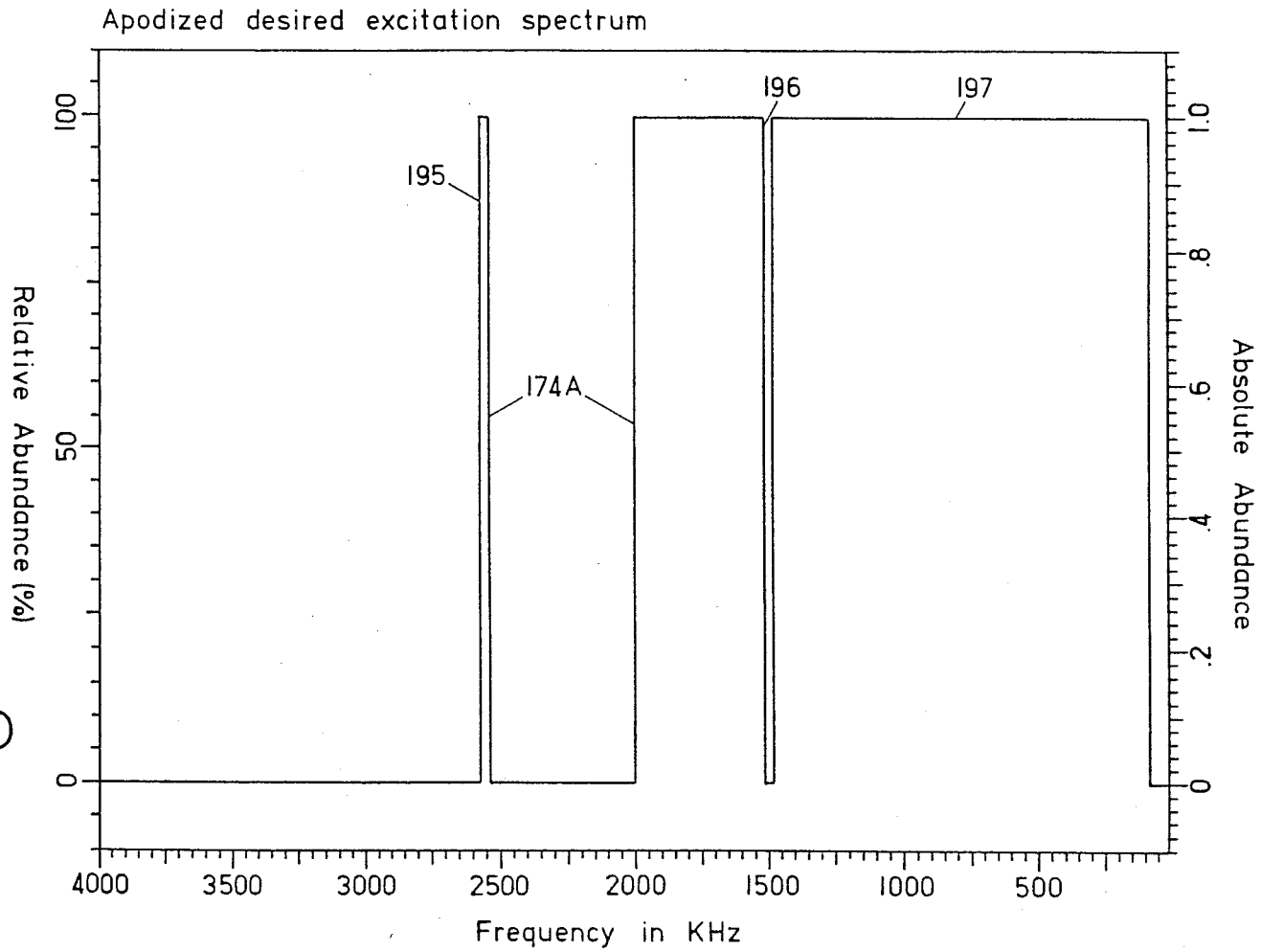
FIG. 10 is a graph showing the forward Fourier transform of the time domain waveform of FIG. 9.

FIG. 10 is a graph 174A showing the forward Fourier transform at 174 after zero filling of the windowed time domain waveform shown in FIG. 9. It can be seen that frequency spectrum 174A has not been distorted. However, when a time domain waveform corresponding to a phase scrambled frequency spectrum is windowed, as in the prior art, the corresponding frequency spectrum is distorted.

Figure 11:
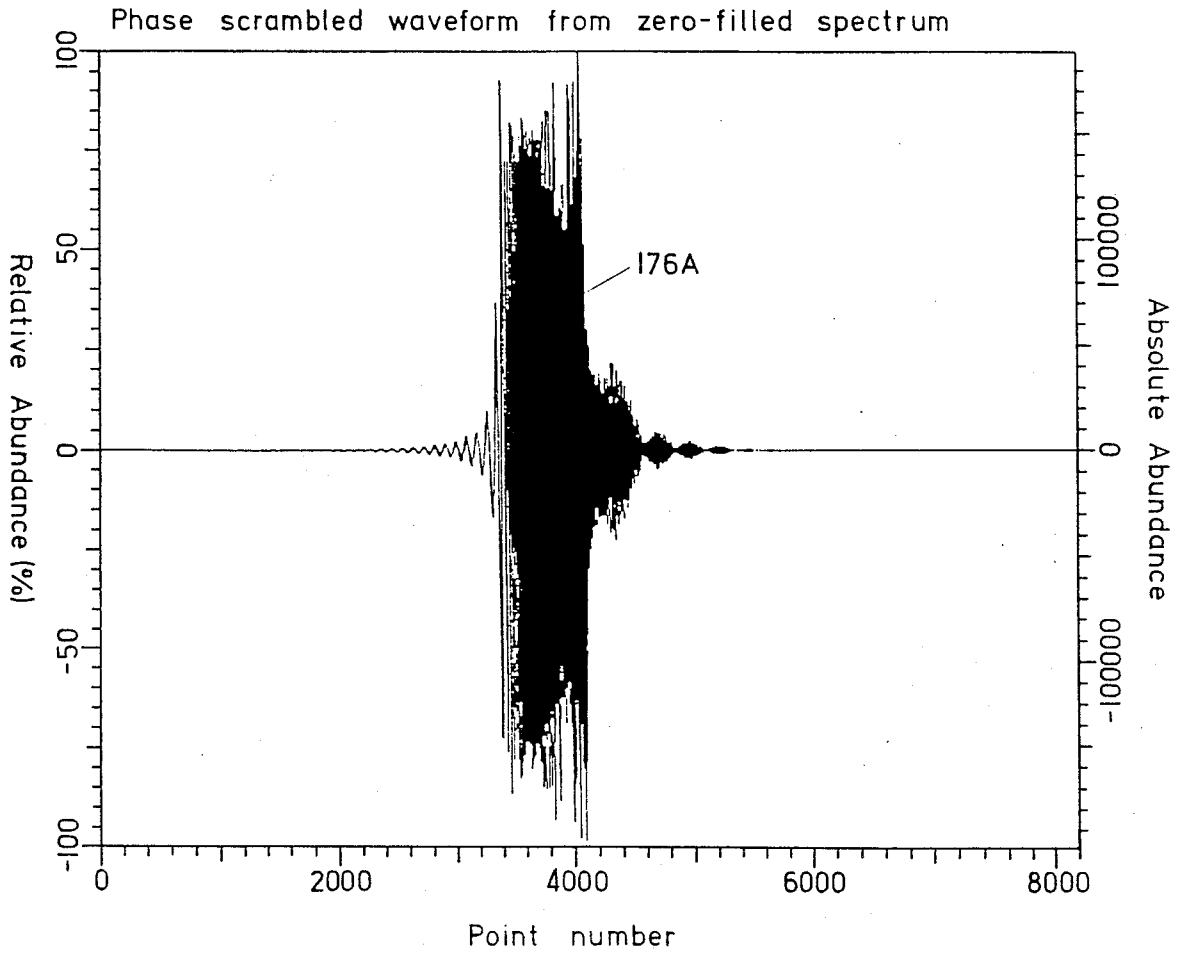
FIG. 11 is a graph showing the inverse Fourier transform of the frequency spectrum depicted in FIG. 10 after phase-scrambling.

FIG. 11 is a graph 176A showing the time domain waveform created at 176, by phase scrambling at 175, and then inverse Fourier transforming and time shifting the frequency spectrum 174A shown in FIG. 10. Phase scrambling the frequency spectrum reduces the peak excitation voltage, thus making it possible to produce this signal using power amplifiers currently available. The time domain waveform, labeled 176A in FIG. 11 is then used to generate the electric field at 177.

Figure 12:
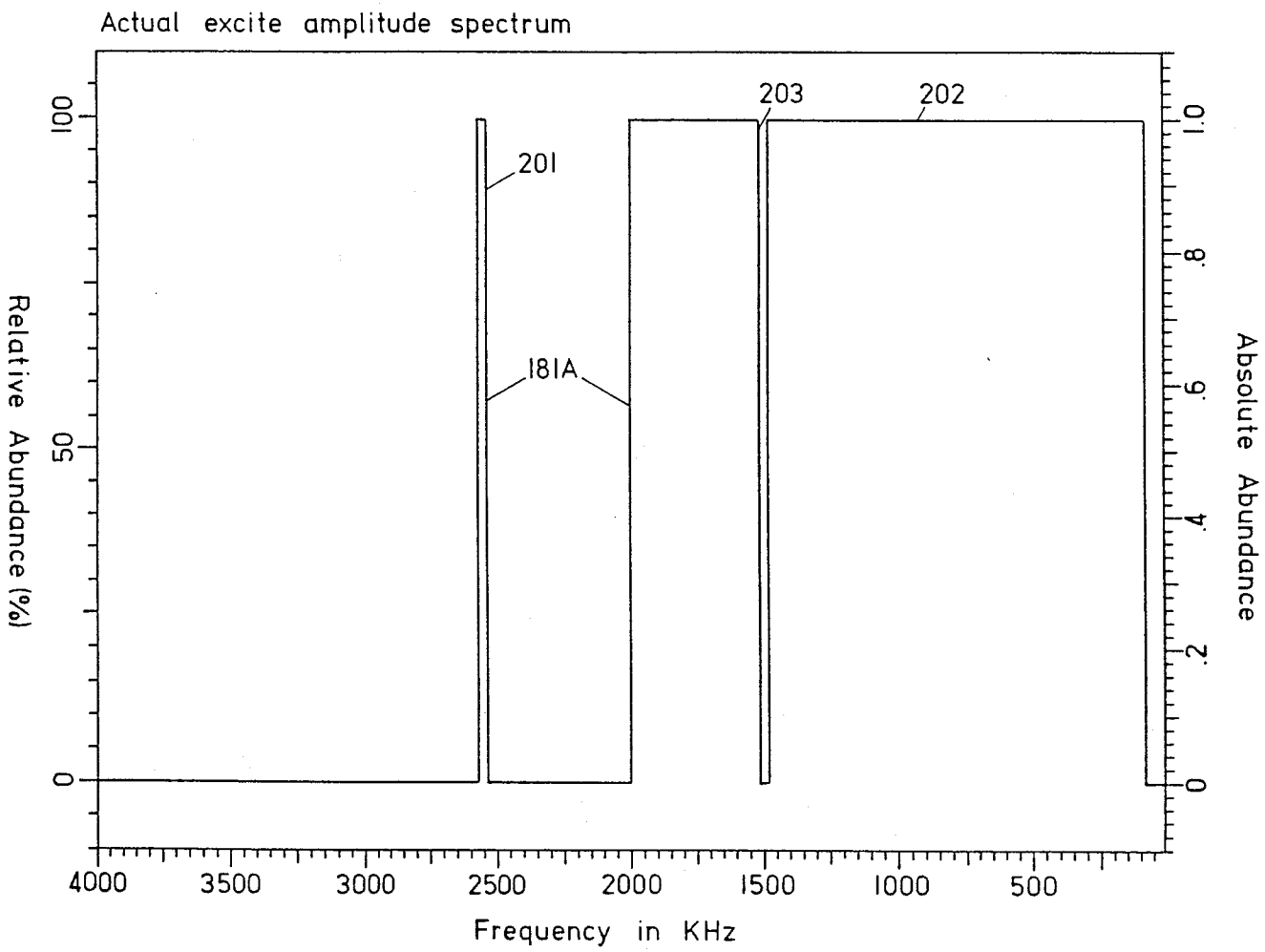
FIG. 12 is a graph showing the frequency spectrum of the final applied time domain waveform.

FIG. 12 is the actual excite amplitude spectrum corresponding to the time domain waveform of FIG. 11. By comparing the output frequency spectrum to the desired frequency spectrum 170A shown in FIG. 7 it may be seen that the output frequency spectrum has been smoothed but not otherwise distorted. In particular the narrow peak 201, the broad band 202, and the well 203 have all been faithfully reproduced.

Figure 13:
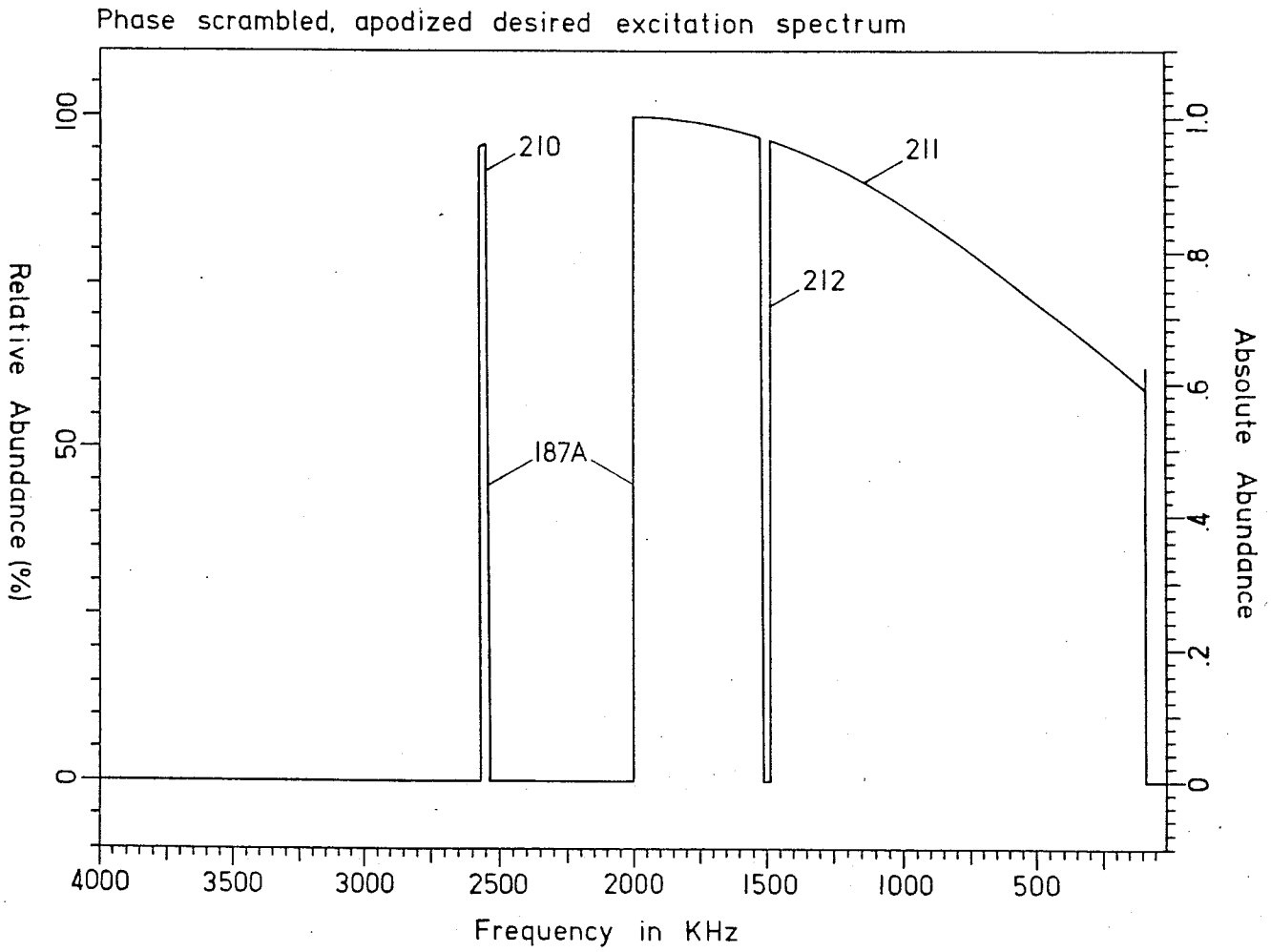
FIG. 13 is a graph showing the output frequency spectrum according to the iterative method, before iteration, using the frequency spectrum depicted in FIG. 7 as the desired excite amplitude spectrum.

FIG. 13 is a graph showing the output frequency spectrum, generated at block 187 by the iterative method, after the initial phase scrambling, inverse Fourier transforming, and apodizing of the desired frequency spectrum. The spectrum 170A of FIG. 7 was used as the desired excite amplitude spectrum and working spectrum, and the spectrum 174A of FIG. 10 is the reference spectrum. It may be seen that frequency spectrum 187A is distorted when compared to the reference spectrum 174A. The narrow peak 210 has several distortions; first, it is not the same magnitude as broad band 211, and second, it is not equal in magnitude for all frequencies within the narrow peak. Broad band 211 also has two distortions the magnitude decreases as frequency decreases, and there is a spike at the lowest frequency. These distortions are also representative of those that occur when the prior art methods are used, since the initial stages of the iterative method are essentially the same as in the prior art.

Figure 14:
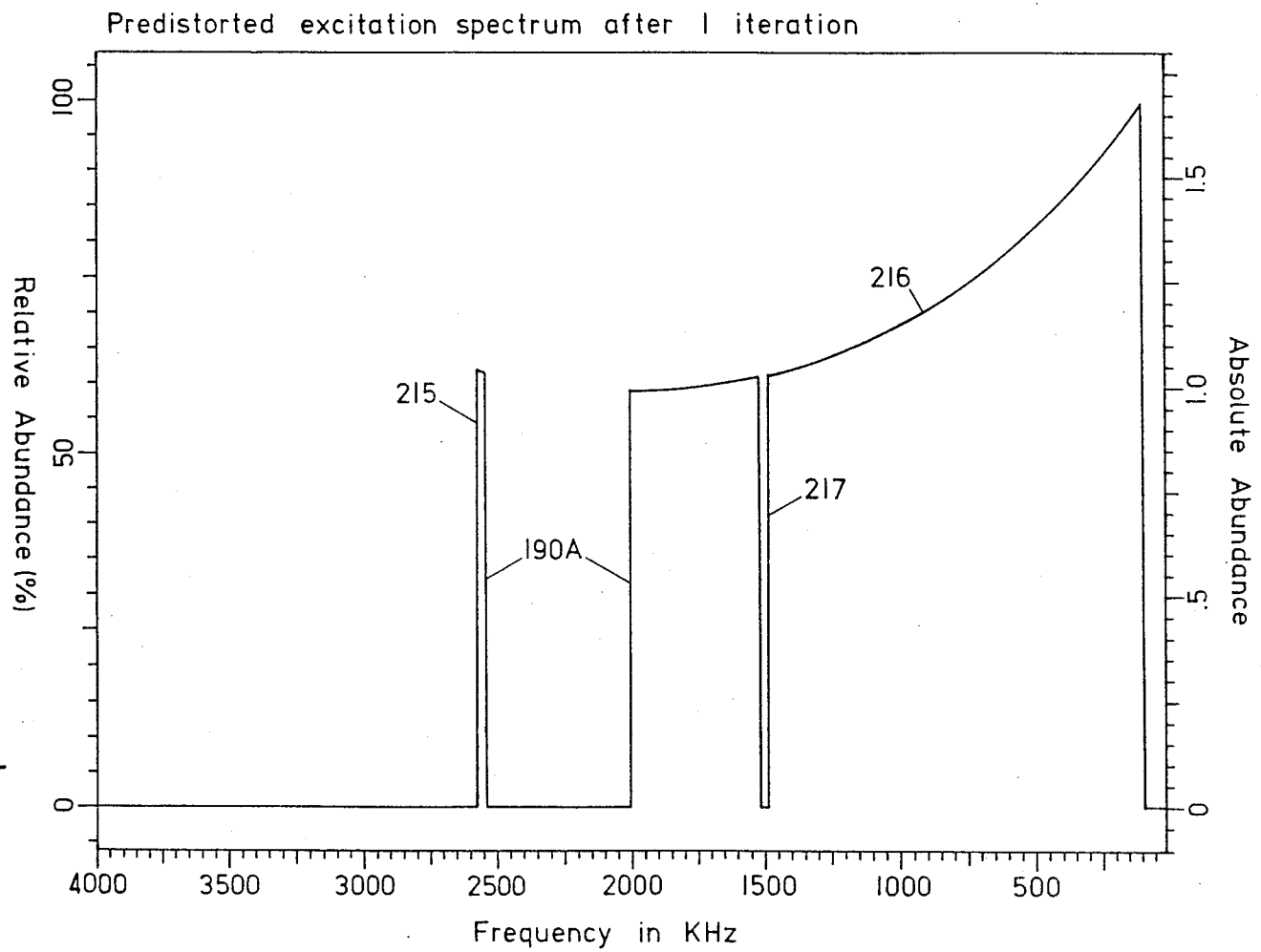
FIG. 14 is a graph showing a predistorted working spectrum using the frequency spectrum depicted in FIG. 13 as the output spectrum and the frequency spectrum depicted in FIG. 10 as the prior working spectrum.

FIG. 14 is a graph showing a pre-distorted frequency spectrum 190A as generated at 190. The output frequency spectrum at 187A shown in FIG. 13, the working spectrum 170A shown in FIG. 7, and the reference spectrum 174A shown in FIG. 10 were used to generate the predistorted frequency spectrum labeled 190A in FIG. 14. For the purposes of this graph, the ratio method of predistorting, using a constant scaling factor of 1.0, was used. At 100 kHz, the magnitudes of both the working spectrum 170A and the reference spectrum 174A are 1.0 and the magnitude of the output spectrum 187A is 0.6. Therefore, the magnitude of the predistorted spectrum 190A is 1.67 at 100 KHz.

Figure 15:
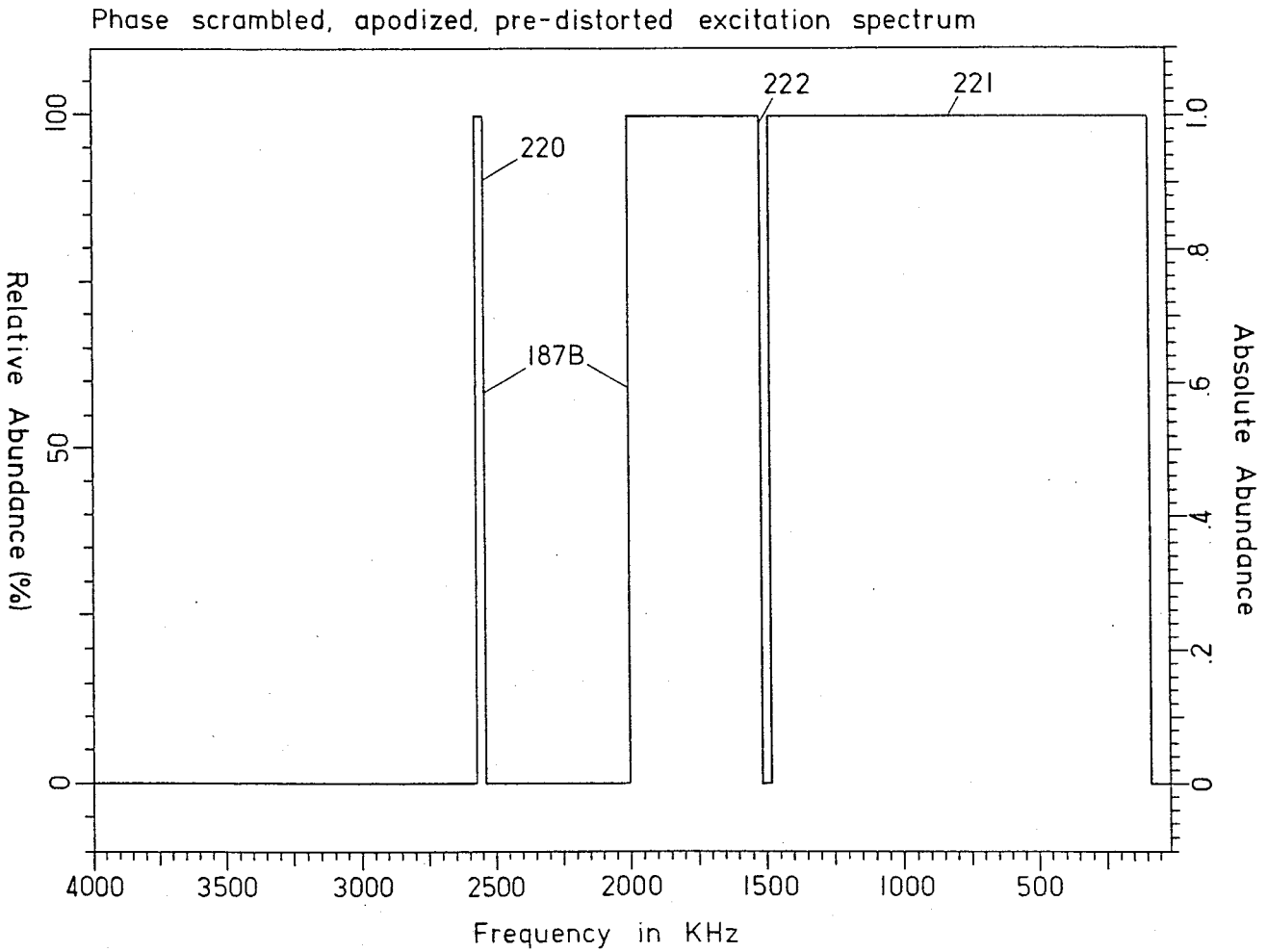
FIG. 15 is a graph showing the output frequency spectrum using the iterative method and using the frequency spectrum depicted in FIG. 14 as the working spectrum.

FIG. 15 is a graph showing the output frequency spectrum, labeled 187B after one iteration using the desired frequency spectrum 170A as the first working spectrum and the predistorted frequency spectrum 190A as the second working spectrum. Using the iterative method it is possible to obtain a time domain waveform with a corresponding frequency spectrum 187B which is very similar to the desired frequency spectrum 170A. The narrow peak 220 is an accurate reproduction of the narrow peak 201. Also, the broad band 221 is an accurate reproduction of the broad band 202 of FIG. 12, and the well 222 is an accurate reproduction of the well 203 of FIG. 12.

By selecting an appropriate phase shift function, it is possible to obtain the best peak excitation voltage reduction. The optimum phase shift function would shift the point of maximum amplitude in the time domain corresponding to each frequency to a different point in the time domain waveform. An example of the derivation of such a function for the special case of a frequency spectrum having equal magnitude for all frequencies (a white noise spectrum), is as follows:

$$T = \frac{-d\theta}{d\omega}$$

where

T = shift of maximum amplitude in time domain for a given frequency, $\theta$ = phase shift (radians), $\omega$ = angular frequency (varying from 0 to $\omega_1$).

Let T be a linear function of $\omega$ with a minimum of $-k$ at $\omega=0$ and maximum of $+k$ at $\omega=\omega_1$, thereby dispersing the points of maximum magnitude equally throughout the time domain waveform.

$$T(\omega) = m\omega + b$$
$$T(0) = b = -k$$
$$T(\omega) = m\omega - k$$
$$T(\omega_1) = m\omega_1 - k = k$$

$$m = \frac{2k}{\omega_1}$$

$$T(\omega) = \frac{2k}{\omega_1}\omega - k = \frac{-d\omega}{d\omega}$$

$$\text{Therefore, } -d\theta = \left(\frac{2k}{\omega_1}\omega - k\right)d\omega$$

-continued and integrating: $-\theta = \frac{k}{\omega_1}\omega^2 - k\omega + c$ As shown above, a phase shift function that is a quadratic function of frequency results in large peak to average power reduction. For the more realistic situation where the frequency function $F(j\omega)$ consists of several bands, each of constant magnitude, the optimal phase function consists of a series of quadratics connected by constant slope segments. However, use of a window function removes the discontinuities from $F(j\omega)$ and ensures that its shape is not as simple as either of these cases discussed above.

Figure 16:
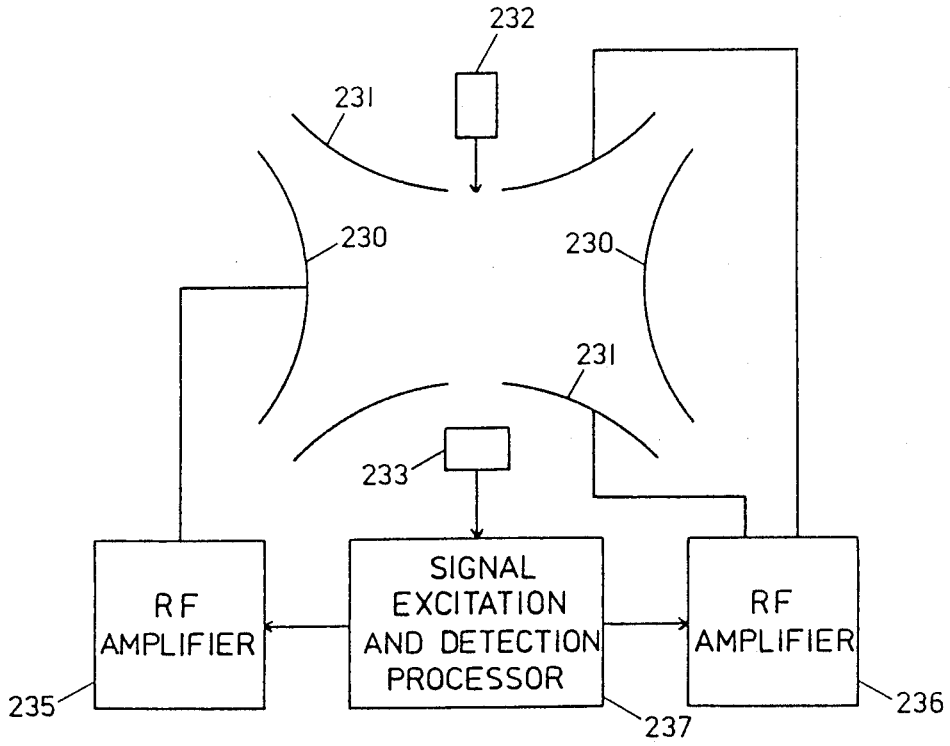
FIG. 16 is a simplified view of an ion trap cell system with which the present invention may be utilized.

Although the present invention has been illustrated with respect to an ion cyclotron resonance cell, it is understood that the principles of the invention may similarly be applied to analogous structures, such as the ion trap, which do not utilize a constant ambient magnetic field. Such an ion trap is illustrated in FIG. 16, having a ring electrode 230, end plates 231, an ionizing beam source 232 such as an electron gun, and a detector of ejected ions 233. Appropriate trapping voltages are applied to the ring electrode 230 and end plates 231 through radio frequency amplifiers and biasing circuits 235 and 236 to cause trapping of the ions within the plates in a well-known manner. The excitation functions of the present invention may be applied to the end plates 231 by a computer controlled signal excitation and detection processor 237, in the same manner as the excitation of the plates 102 and 103 of the ICR cell 101 as described above, to achieve excitation and ejection of ions from the ion trap. The ejected ions can be detected by the detector 233 and analyzed by the processor 237 to provide a mass spectrum of the ejected ions. By applying the excitation principles of the present invention, ejection can be obtained of all masses within an excitation band or ejection of all masses above and below a selected band.

In accordance with the present invention, stored waveform excitation may be applied to the cell in a time-shared manner with detection, sometimes called "stochastic" excitation and detection. In a time-shared mode, the time domain excitation waveform is stored in the memory 121 as above, but would not be fed directly to the digital-to-analog converter 124 which is utilized in the system of FIG. 2 to generate a continuous time domain waveform. In the time-shared mode, each data point from the memory 121, corresponding to the magnitude of the desired time domain waveform at that instant, is translated to a pulse having an area proportional to the desired time domain amplitude, and the sequence of pulses corresponding to the data read out sequentially from the memory 121 is applied to the plates 102 and 103. The pulse areas may be varied by using pulses of constant amplitude and varying duration, pulses of constant duration and varying amplitude, and pulses of constant amplitude and duration but varying phase. The signal from the detector plates 107 and 108 is gated so that it is detected only during the intervals between pulses supplied to the excitation plates, developing data in a time-shared manner which is indicative of the response of the ions within the cell to the pulse encoded time domain excitation waveform.

The present method and apparatus are extremely general in application to mass spectrometry and are not limited to the examples illustrated herein. It is evident that a great variety of excitation spectra can be tailored in accordance with the principles of the present invention to meet specific needs.

It is understood that the invention is not confined to the particular embodiments set forth herein as illustrative, but embraces such modified forms thereof as come within the scope of the following claims.

What is claimed is:

1. Ion mass spectrometry apparatus comprising:

(a) an ion cell including a plurality of electrode plates;

(b) means for detecting motion of ions in the cell and providing a signal indicative thereof;

(c) means for producing a desired first discrete frequency spectrum;

(d) means for producing a first time domain waveform which is the inverse Fourier transform of the desired first discrete frequency spectrum followed by a time shift of half its length;

(e) means for producing a second time domain waveform which is the first time domain waveform multiplied by a window function, wherein the window function varies as a function of time from zero magnitude at the beginning and the end of the time domain waveform to a maximum magnitude level therebetween and has zero value over a segment at each end of the function;

(f) means for producing a second discrete frequency spectrum which is the forward Fourier transform of the second time domain waveform;

(g) phase scrambling means for producing a third discrete frequency spectrum which has the magnitude of the second discrete frequency spectrum with the phases of the discrete frequencies of the second discrete frequency spectrum varied as a non-constant function of frequency such that all discrete frequencies of the third discrete frequency spectrum are not in phase at any point in time and the group delays of the phase function are less than or equal to the length of the zero value segments of the window function;

(h) means for producing a third time domain waveform which is the inverse Fourier transform of the third discrete frequency spectrum followed by a time shift of half its length; and (i) excitation means connected to the ion cell for producing an electric field in the cell which corresponds to the third time domain waveform.

2. The apparatus of claim 1 wherein the phase function of the phase scrambling means is selected to provide the maximum reduction in the required level of excitation voltage which produces the electric field in the cell without distorting the excitation amplitude spectrum.

3. The apparatus of claim 1 in which the phases of the discrete frequencies of the second discrete frequency spectrum are varied by the phase scrambling means as a non-linear continuous function.

4. The apparatus of claim 1 wherein the zero and non-zero portions of the expanded window function applied by the means for producing a second time domain waveform are selected to be of substantially the minimum width required so that the third discrete frequency spectrum corresponding to the time domain waveform is not substantially distorted from the desired first discrete frequency spectrum.

5. The apparatus of claim 1 wherein the excitation means includes means for mixing a first higher frequency carrier signal with the third time domain waveform and wherein the excitation means produces an electric field in the cell which varies in accordance with the first higher frequency signal modulated by the third time domain waveform.

6. The apparatus of claim 5 including means for mixing the signal indicative of an ion motion with a second higher frequency carrier signal to produce a mixed signal having sum and difference frequency components and including means for filtering the mixed signal to isolate the difference frequency components indicative of an ion resonance response.

7. The apparatus of claim 1 wherein the means for producing a desired first discrete frequency spectrum further comprises means for providing a desired mass-domain excitation profile and means for producing a first discrete frequency spectrum from the desired mass-domain excitation profile.

8. The apparatus of claim 1 wherein:

(a) the excitation means includes:

digital memory means for storing digital data in sequential locations which can be selectively read out, the magnitude of the digital data stored corresponding to the third time domain waveform;

digital-to-analog converter means connected to receive digital data from the digital memory means and connected for providing its output analog signal to the ion cell;

means for selectively controlling the output of the digital data stored in the digital memory means to the digital-to-analog converter means to control the application of the third time domain waveform in the digital memory means in analog form to the ion cell; and (b) the means for detecting motion of an ion in the cell includes:

amplifier means, having its input connected to a plate of the ion cell serving as a detector plate, for providing an output signal which is an amplified output of an electrical signal at the detector plate;

analog-to-digital converter means, connected to the output of the amplifier means, for converting the output signal thereof from an analog to a digital data signal;

means connected to receive the analog-to-digital converter means digital data output for providing output data indicative of the Fourier transform of the data signal from the analog-to-digital converter means.

9. The apparatus of claim 1 wherein the ion cell is of the ion cyclotron resonance type having excitation plates and detection plates, and further including;

(a) a magnet producing a substantially constant and unidirectional magnetic field through the ion cyclotron resonance cell such that the electric field from potentials applied to the excitation plates is transverse to the applied magnetic field;

(b) excitation amplifier means connected to the excitation plates for applying electric potentials to the plates to form an electric field between the plates in accordance with an input signal to the excitation amplifier means;

(c) digital memory means containing data stored in sequential locations, a magnitude of the digital data stored corresponding to the third time domain waveform;

(d) digital-to-analog converter means connected to receive digital data input from the digital memory and connected for providing its output analog signal corresponding to the digital data to the excitation amplifier means.

10. The apparatus of claim 1 wherein the ion cell is an ion trap cell of the type having a ring electrode and end plates and the ion excitation causes the selected mass-to-charge ratio ions to be ejected from the ion trap cell.

11. A method of providing ion excitation to an ion cell, comprising the steps of:

(a) creating a desired first discrete frequency spectrum which corresponds to a range or ranges of ion mass-to-charge ratios to be excited or ejected;

(b) inverse Fourier transforming the desired first discrete frequency spectrum and time shifting by half its length to provide data indicative of a first time domain waveform corresponding to the inverse Fourier transform;

(c) multiplying the data indicative of the first time domain waveform by a window function which varies as a function of time from zero magnitude at the beginning and the end of the time domain waveform to a maximum magnitude level therebetween, the window function having a zero value over a segment of each end of the function, to provide data indicative of a second time domain waveform having zero magnitude at the beginning and the end of the second time domain waveform and a maximum therebetween;

(d) forward Fourier transforming the data indicative of second time domain waveform to produce a second discrete frequency spectrum;

(e) applying to each discrete frequency of the second discrete frequency spectrum a phase such that the phases of the discrete frequencies of the second discrete frequency spectrum are varied as a non-constant function of frequency to produce a third discrete frequency spectrum such that all discrete frequencies of the third discrete frequency spectrum are not in phase at any point in time and the group delays of the phase function are less than or equal to the length of the zero value segments of the window function;

(f) inverse Fourier transforming and shifting by half its length the third discrete frequency spectrum to provide data indicative of a third time domain waveform corresponding to the inverse Fourier transform of the third discrete frequency spectrum;

(g) applying an electric field to the ion cell which has a time domain waveform which corresponds to the data indicative of the third time domain waveform;

(h) detecting ion motion in the cell and providing a signal indicative thereof.

12. The method of claim 11 wherein the step of creating a desired first discrete frequency spectrum further comprises the steps of creating a desired mass domain excitation profile which corresponds to selected mass-to-charge ratios of a range or ranges of ions to be excited and their respective excited orbital radii and a range or ranges of ions to be excluded from excitation, and creating a first discrete frequency spectrum which corresponds to the desired mass-domain excitation profile.

13. The method of claim 11 wherein the phase function in the step of applying a phase to each discrete frequency is selected to provide the maximum reduction in the required level of excitation voltage which produces the electric field in the cell without distorting the excitation amplitude spectrum.

14. The method of claim 11 in which the phases of the discrete frequencies of the third discrete frequency spectrum are varied as a non-linear, continuous function.

15. The method of claim 11 wherein the zero and non-zero portions of the expanded window function applied on the data are selected to be of substantially the minimum width required so that the discrete frequency spectrum corresponding to the third time domain waveform is not substantially distorted from the desired first discrete frequency spectrum.

16. The method of claim 11 including after the step of inverse Fourier transforming and time shifting the third discrete frequency spectrum the additional steps of converting the data indicative of the time domain waveform to an analog time domain signal and mixing a first higher frequency carrier signal with the analog time domain signal to provide a heterodyne signal, and wherein in the step of applying an electric field, the electric field applied has a time domain waveform which corresponds to the heterodyne signal comprising the mixed time domain signal and the first higher carrier frequency signal.

17. The method of claim 16 including the additional steps of detecting cyclotron resonance motion of ions in the cell and providing a signal indicative thereof, mixing the signal indicative of the ion cyclotron resonance motion with a second higher frequency carrier signal to produce a mixed signal having sum and difference frequency components, and isolating the difference frequency components indicative of the ion cyclotron resonance response.

18. The method of claim 11 wherein the ion cell is an ion trap cell of the type having a ring electrode and end plates and the ion excitation causes the selected mass to charge ratio ions to be ejected from the ion trap cell.

19. The method of claim 11 wherein the ion cell is of the ion cyclotron resonance type having excitation plates and detection plates.

20. Ion mass spectrometry apparatus comprising:

(a) an ion cell including a plurality of electrode plates;

(b) means for detecting motion of ions in the cell and providing a signal indicative thereof;

(c) means for producing a desired discrete frequency spectrum as a first frequency spectrum;

(d) phase scrambling means for producing a second discrete frequency spectrum which has the magnitude of the first discrete frequency spectrum with the phases of the discrete frequencies of the first discrete frequency spectrum varied as a non-constant function of frequency such that all discrete frequencies of the second discrete frequency spectrum are not in phase at any point in time;

(e) means for producing a first time domain waveform which is the inverse Fourier transform of the second discrete frequency spectrum;

(f) means for producing a second time domain waveform wherein the first half of the first time domain waveform is shifted forward in time one half of the length of the first time domain waveform and the second half of the first time domain waveform is shifted backward in time one half of the length of the first time domain waveform;

(g) means for producing a third time domain waveform which is the second time domain waveform multiplied by a window function;

(h) means for producing a third discrete frequency spectrum which is the forward Fourier transform of the second time domain waveform;

(i) excitation means for producing an electric field in the cell which corresponds to the second time domain waveform when provided with the second time domain waveform data;

(j) means for producing a reference spectrum from the first frequency spectrum which can be used to judge the convergence of the third frequency spectrum;

(k) means for predistorting the magnitudes of the first frequency spectrum at each frequency by an amount related to the error at each frequency between the third frequency spectrum and the reference frequency spectrum to produce a fourth frequency spectrum, and for providing the fourth frequency spectrum to the phase scrambling means to replace the first frequency spectrum; and (l) means for comparing the magnitude of the third frequency spectrum and the reference frequency spectrum to determine if they match within a selected maximum deviation, and (1) if they do match, applying the third time domain waveform to the excitation means, or (2) if they do not match, applying the third frequency spectrum to the means for predistorting.

21. The apparatus of claim 20 wherein the means for producing a desired discrete frequency spectrum as a first frequency spectrum further includes means for producing a desired mass domain excitation profile and means for producing the first frequency spectrum from the desired mass-domain excitation profile.

22. The apparatus of claim 20 wherein the means for producing a reference spectrum includes means for inverse Fourier transforming the first frequency spectrum, time shifting the resulting waveform by half its length, multiplying the time shifted waveform by a window-function, and forward Fourier transforming the windowed waveform to produce a reference frequency spectrum.

23. The apparatus of claim 20 wherein the means for predistorting produces the fourth frequency spectrum at each frequency as the magnitude at that frequency of the first frequency spectrum plus the difference between the magnitudes of the corresponding frequency of the reference spectrum and the third frequency spectrum.

24. The apparatus of claim 20 wherein the means for predistorting produces the fourth frequency spectrum at each frequency as the magnitude at that frequency of the first frequency spectrum multiplied by the ratio of the magnitude of the corresponding frequency of the reference frequency spectrum to the magnitude of the corresponding frequency of the third frequency spectrum.

25. The apparatus of claim 23 wherein the difference between the magnitudes of the reference spectrum and third frequency spectrum is multiplied by a scaling factor not equal to one and the product added to the magnitude of the first frequency spectrum to produce the fourth frequency spectrum.

26. The apparatus of claim 20 in which the phases of the discrete frequencies of the second discrete frequency spectrum are varied by the phase scrambling means as a non-linear continuous function.

27. The apparatus of claim 20 wherein the excitation means includes means for mixing a first higher frequency carrier signal with the third time domain waveform and wherein the excitation means produces an electric field in the cell which varies in accordance with the first higher frequency signal modulated by the third time domain waveform.

28. The apparatus of claim 27 wherein the excitation means includes:

(a) digital memory means for storing digital data in sequential locations which can be selectively read out, the magnitude of the digital data stored corresponding to the third time domain waveform;

(b) digital-to-analog converter means connected to receive digital data from the digital memory means and connected for providing its output analog signal to the ion cell;

(c) means for selectively controlling the output of the digital data stored in the digital memory means to the digital-to-analog converter means to control the application of the third time domain waveform in the digital memory means in analog form to the ion cell.

29. The apparatus of claim 20 wherein the means for detecting includes an amplifier means, having its input connected to plates of the ion cell serving as detector plates, for providing an output signal which is an amplified output of an electrical signal at the detector plates, and further including analog-to-digital converter means, connected to the output of the amplifier means, for converting the output signal thereof from an analog to a digital data signal;

means connected to receive the analog-to-digital converter means digital data output for providing output data indicative of the Fourier transform of the data signal from the analog-to-digital converter means.

30. The apparatus of claim 20 wherein the ion cell is of the ion cyclotron resonance type having excitation plates and detection plates, and further including;

(a) a magnet producing a substantially constant and unidirectional magnetic field through the ion cyclotron resonance cell such that the electric field from potentials applied to the excitation plates is transverse to the applied magnetic field;

(b) excitation amplifier means connected to the excitation plates for applying electric potentials to the plates to form an electric field between the plates in accordance with an input signal to the excitation amplifier means;

(c) digital memory means containing data stored in sequential locations, the magnitude of the digital data stored corresponding to the third time domain waveform; and (d) digital-to-analog converter means connected to receive digital data input from the digital memory and connected for providing its output analog signal corresponding to the digital data to the excitation amplifier means.

31. The apparatus of claim 20 wherein the ion cell is an ion trap cell of the type having a ring electrode and end plates and the ion excitation causes the selected mass to charge ratio ions to be ejected from the ion trap cell.

32. A method of providing ion excitation to an ion cell, comprising the steps of:

(a) creating a desired discrete frequency spectrum, as a first frequency spectrum, which corresponds to a range of ion mass-to-charge ratios to be excited or ejected;

(b) applying to each frequency of the first discrete frequency spectrum a phase such that the phases of the frequencies of the first discrete frequency spectrum are varied as a non-constant function of frequency to produce a second frequency spectrum such that all discrete frequencies of the second discrete frequency spectrum are not in phase at any point in time;

(c) inverse Fourier transforming the second discrete frequency spectrum to provide data indicative of a first time domain waveform corresponding to the inverse Fourier transform;

(d) shifting the first half of the first time domain waveform forward in time one half of the length of the first time domain waveform, and shifting the second half of the first time domain waveform backward in time one half of the length of the first time domain waveform to produce a second time domain waveform;

(e) multiplying the data indicative of the second time domain waveform by a window function to provide data for a third time domain waveform;

(f) forward Fourier transforming the data for the third time domain waveform to produce a third discrete frequency spectrum;

(g) creating a reference frequency spectrum from the first frequency spectrum which can be used to judge the convergence of the third frequency spectrum;

(h) when the magnitude of each discrete frequency of the third discrete frequency spectrum is not sufficiently close to the magnitude of the corresponding discrete frequency of the reference frequency spectrum, creating a fourth frequency spectrum by increasing or decreasing the magnitude of each frequency of the first discrete frequency spectrum such that the difference between the magnitude of each frequency of the third discrete frequency spectrum and the magnitude of each frequency of the reference spectrum will decrease when the above steps are repeated with the first frequency spectrum replaced by the fourth frequency spectrum; and (i) when the magnitude of each discrete frequency of the third discrete frequency spectrum is sufficiently close to the magnitude of the corresponding discrete frequency of the reference spectrum, producing an electric field in the ion cell which corresponds to the third time domain waveform.

33. The method of claim 32 wherein the step of creating a desired discrete frequency spectrum as a first frequency spectrum includes the steps of creating a desired mass domain excitation profile corresponding to selected mass-to-charge ratios of a range or ranges of ions to be excited and a range or range of ions to be excluded from excitation, and creating a first frequency spectrum which corresponds to the desired mass domain excitation profile.

34. The method of claim 32 wherein the step of creating the reference spectrum comprises the steps of inverse Fourier transforming the first frequency spectrum, time shifting the resulting waveform by half its length, multiplying the shifted waveform by a window function, and forward Fourier transforming the windowed waveform to produce the reference spectrum.

35. The method of claim 32 wherein, in the step of creating the fourth frequency spectrum, the magnitude of each frequency of the fourth frequency spectrum is proportional to the magnitude of the corresponding frequency of the first discrete frequency spectrum multiplied by the ratio of the magnitude of the corresponding frequency of the reference frequency spectrum to the magnitude of the corresponding frequency of the third discrete frequency spectrum.

36. The method of claim 32 wherein, in the step of creating the fourth frequency spectrum, the magnitude of each frequency of the fourth frequency spectrum is proportional to the magnitude of the corresponding frequency of the first discrete frequency spectrum plus the difference between the magnitudes of the corresponding frequency of the reference spectrum and the third frequency spectrum.

37. The method of claim 32 in which the phases of the discrete frequencies of the second frequency spectrum are varied as a non-linear, continuous function.

38. The method of claim 36 wherein the difference between the magnitudes of the reference spectrum and third frequency spectrum is multiplied by a scaling factor not equal to one and the product added to the magnitude of the first frequency spectrum to produce the fourth frequency spectrum.

39. The method of claim 32 wherein the step of producing an electric field in the ion cell includes the additional steps of converting the data indicative of the third time domain waveform to an analog time domain signal and mixing a first higher frequency carrier signal with the analog time domain signal to provide a modulated signal which is applied to create the electric field.

40. The method of claim 39 including the additional steps of detecting ion cyclotron resonance motion of ions in the cell and providing a signal indicative thereof, mixing the signal indicative of the ion cyclotron resonance motion with a second higher frequency carrier signal to produce a mixed signal having sum and difference frequency components, and isolating the difference frequency components indicative of the ion cyclotron resonance response.

41. The method of claim 32 wherein the ion cell is an ion trap cell of the type having a ring electrode and end plates and the ion excitation causes the selected mass to charge ratio ions to be ejected from the ion trap cell.

42. The method of claim 32 wherein the ion cell is of the ion cyclotron resonance type having excitation plates and detection plates, and a magnet producing a substantially constant and unidirectional magnetic field through the ion cyclotron resonance cell such that the electric field from potentials applied to the excitation plates is transverse to the applied magnetic field.

* * * * *